US006349934B1

(12) United States Patent
Ishiguro et al.

(10) Patent No.: US 6,349,934 B1
(45) Date of Patent: Feb. 26, 2002

(54) RECIPROCATING TRAY FOR SHEET FINISHER

(75) Inventors: Kuniaki Ishiguro, Toyokawa; Riichi Hama, Aichi-Ken; Tatsuya Shinno, Toyokawa; Tohru Murakami, Okazaki; Norikazu Okabe, Toyokawa; Motoki Takata, Toyohashi, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/396,204

(22) Filed: Sep. 15, 1999

(30) Foreign Application Priority Data

| | | |
|---|---|---|
| Sep. 17, 1998 | (JP) | 10-263069 |
| Sep. 17, 1998 | (JP) | 10-263108 |
| Sep. 17, 1998 | (JP) | 10-263163 |
| Sep. 17, 1998 | (JP) | 10-263171 |

(51) Int. Cl.[7] ..... B65H 31/12
(52) U.S. Cl. ..... 271/218; 271/214; 270/58.07
(58) Field of Search ..... 270/58.07, 58.08, 270/58.11, 58.12, 58.13; 271/218, 214; 414/791.2

(56) References Cited

U.S. PATENT DOCUMENTS

| | | | | |
|---|---|---|---|---|
| 4,611,741 A | * | 9/1986 | Wilson | 270/58.08 X |
| 5,021,837 A | | 6/1991 | Uto et al. | |
| 5,098,074 A | * | 3/1992 | Mandel et al. | 270/58.11 X |
| 5,649,695 A | | 7/1997 | Lawrence | |

FOREIGN PATENT DOCUMENTS

| | | | |
|---|---|---|---|
| JP | 10-258962 | | 9/1998 |
| JP | 410258957 | * | 9/1998 |
| JP | 410258962 | * | 9/1998 |
| JP | 410258963 | * | 9/1998 |

* cited by examiner

*Primary Examiner*—Christopher P. Ellis
*Assistant Examiner*—Patrick Mackey
(74) *Attorney, Agent, or Firm*—McDermott, Will & Emery

(57) ABSTRACT

A sheet accommodating device comprising a sheet-laid tray including a processing tray and a carrying tray; a discharge tray; a sheet accommodating unit; first, second and third sheet transporting paths for leading the discharged sheet to the sheet-laid tray, the sheet accommodating unit and the discharge tray, respectively; a transporting and aligning device for moving the sheet discharged onto the sheet-laid tray toward an alignment reference position; a detector for detecting a vertical position of an upper surface of the sheet on the carrying tray; a tray position adjusting device for adjusting the vertical position of the carrying tray based on a result of detection by the detector ; controller for raising or lowering the carrying tray; and others, the second sheet transporting path extending through the escape position of the processing tray, as well as a sheet processing system including a combination of the sheet accommodating device and an image forming apparatus.

7 Claims, 17 Drawing Sheets

RECIPROCATING TRAY FOR SHEET FINISHER

The invention is based on patent application Nos. 10-263069 Pat., 10-263108 Pat., 10-263163 Pat. and 10-263171 Pat. filed in Japan, the contents of which are hereby incorporated by reference.

BACKGROUND OF THE INVENTION

1. Field of the Invention

The present invention relates to a sheet accommodating device for accommodating sheets which are discharged from a sheet processing device such as an image forming apparatus (e.g., a copying machine, a printer, a facsimile or a composite device formed of two or more of them), and also relates to a sheet processing system formed of a combination of such a sheet accommodating device and an image forming apparatus.

2. Description of the Background Art

A sheet accommodating device for accommodating sheets discharged from a sheet processing device usually has a tray for successively carrying and accommodating the discharged sheets. The tray may be combined with a sheet aligning device, a binding device for binding a plurality of sheets and/or other post-processing device.

In many cases, however, the sheet discharged from the sheet processing device is partially or entirely curled due to an influence such as a heat and a pressure applied thereto from the sheet processing device.

The sheet laid on the tray or the sheet bundle, which is formed of several sheets laid on the tray, may be aligned with a predetermined aligning position together with the next sheet(s) which are discharged onto the sheet or sheet bundle. Further, the sheets thus aligned may be subjected to the post-processing. In these cases, the overlaid sheet(s) cannot be stable, and thus cannot be processed (e.g., aligned) in an intended manner if the underlying sheet or sheet bundle on the tray is curled. The aligning and other processing cannot be easily performed if the overlaid sheet to be processed is curled.

The sheet accommodating device is usually provided with a sheet accommodating portion for accommodating the discharged sheets. The accommodating portion(s) is usually one in number, but a second sheet accommodating portion may be additionally provided in some cases.

The second accommodating portion may be, for example, a sheet accommodating portion which is referred to as a "mail bin" and is provided with a plurality of bins for accommodating the sheets discharged from the sheet processing device in the intended bins corresponding to destinations or the like.

In the sheet accommodating device which is provided with the plurality of sheet accommodating portions, a plurality of complicated transporting paths are required for leading the sheets discharged from the sheet processing device to the respective sheet accommodating portions, respectively. Due to the complicated structure, sheet jamming which impedes the sheet accommodation is liable to occur. Further, these several transportation paths require a large space, and therefore increase the size of the sheet accommodating device.

As described above, the sheet accommodating device suffers from the foregoing problems in connection with smooth and appropriate accommodation of the sheets.

SUMMARY OF THE INVENTION

Accordingly, an object of the invention is to provide a sheet accommodating device which can smoothly accommodate sheets discharged from a sheet processing device in a satisfactory state, compared with conventional sheet accommodating devices.

Another object of the invention is to provide a sheet accommodating device which can smoothly carry and accommodate sheets discharged from a sheet processing device in an aligned fashion.

Still another object of the invention is to provide a sheet accommodating device which can smoothly and accurately align sheets discharged from a sheet processing device while suppressing an influence by curling of the sheets.

Yet another object of the invention is to provide a sheet accommodating device which can smoothly and accurately align sheets discharged from a sheet processing device while suppressing an influence by curling of the sheets already discharged and accommodated.

Further another object of the invention is to provide a sheet accommodating device which can smoothly and accurately align sheets discharged from a sheet processing device while suppressing an influence by curling of the sheets already discharged and accommodated, and can efficiently accommodate the sheets.

A further object of the invention is to provide a sheet accommodating device which can smoothly and accurately align sheets discharged from a sheet processing device while suppressing an influence by curling of the sheets already discharged and accommodated, and does not require particular increase in size of the whole structure.

A further object of the invention is to provide a sheet accommodating device, which can smoothly and appropriately accommodate sheets discharged from a sheet processing device in a plurality of sheet accommodating portions, but can be entirely formed of a relatively small and compact structure.

A further object of the invention is to provide a sheet processing system which is formed of an image forming apparatus and a sheet accommodating device for accommodating the sheets discharged from the image forming apparatus, and can smoothly and appropriately accommodate the sheets discharged from the image forming apparatus.

The invention provides the following sheet accommodating devices.

(1) First Sheet Accommodating Device

A sheet accommodating device including:

- a processing tray movable between a receiving position for receiving a discharged sheet and an escape position, the sheet being aligned in the receiving position;
- a carrying tray for carrying a sheet or sheet bundle moved by its own weight as a result of retreating of the processing tray to the escape position;
- a detector for detecting a vertical position of an upper surface of the uppermost sheet on the carrying tray; and
- a tray position adjusting device for adjusting the vertical position of the carrying tray based on a result of detection by the detector such that the processing tray comes into contact with and pushes the sheet or sheet bundle on the carrying tray when the processing tray is in the receiving position.

(2) Second Sheet Accommodating Device

A sheet accommodating device including:

- a processing tray movable between a receiving position for receiving a discharged sheet and an escape position, the sheet being aligned in the receiving position;
- a carrying tray for carrying a sheet or sheet bundle moved by its own weight as a result of retreating of the processing tray to the escape position; and a pushing member for pushing a rear end, in the sheet discharging direction, of the sheet or sheet bundle toward the carrying tray when the sheet or sheet bundle on the processing tray is moved to the carrying tray as a result of retreating of the processing tray.

(3) Third Sheet Accommodating Device

A sheet accommodating device including:

a sheet-laid tray for laying a discharged sheet thereon;

a transporting and aligning device for moving the sheet laid on the sheet-laid tray to an alignment reference position; and a sheet pushing device including a pushing member for pushing a rear end, in the sheet discharging direction, of the sheet on the sheet-laid tray toward the sheet-laid tray, the pushing member being movable between a sheet pushing position and an escape position.

(4) Fourth Sheet Accommodating Device

A sheet accommodating device including:

a processing tray movable between a receiving position for receiving a discharged sheet and an escape position, the sheet being aligned in the receiving position; and a carrying tray for carrying a sheet or sheet bundle moved by its own weight as a result of retreating of the processing tray to the escape position, the processing tray being formed of a first tray supporting a sheet leading portion in the sheet discharging direction, and a second tray supporting a sheet rear portion.

(5) Fifth Sheet Accommodating Device

A sheet accommodating device including:

a processing tray movable between a receiving position for receiving a sheet and an escape position, the sheet being aligned in the receiving position; and a carrying tray for carrying a sheet or sheet bundle moved by its own weight as a result of retreating of the processing tray to the escape position, the processing tray being configured to retreat preliminarily a predetermined amount within a range allowing post-processing to be effected on a plurality of sheets after receiving the sheets in the receiving position, and then retreat to the escape position.

(6) Sixth Sheet Accommodating Device

A sheet accommodating device including:

a processing tray movable between a receiving position for receiving a sheet and an escape position, the sheet being aligned in the receiving position; and a carrying tray for carrying a sheet or sheet bundle moved by its own weight as a result of retreating of the processing tray to the escape position, the processing tray including a first tray formed of a plurality of divided trays, the plurality of divided trays escaped in the escape position being accommodated in a layered fashion.

(7) Seventh Sheet Accommodating Device

A sheet accommodating device including:

a processing tray movable between a receiving position for receiving a sheet and an escape position, the sheet being aligned in the receiving position;

a carrying tray for carrying a sheet or sheet bundle moved by its own weight as a result of retreating of the processing tray to the escape position; and controller for raising the carrying tray to a sheet carrying position when the processing tray is in the sheet receiving position, and lowering the carrying tray to a lower escape position after the processing tray escaped to the escape position.

(8) Eighth Sheet Accommodating Device

A sheet accommodating device including:

a processing tray movable between a receiving position for receiving a sheet and an escape position, the sheet being aligned in the receiving position;

a carrying tray for carrying a sheet or sheet bundle moved by its own weight as a result of retreating of the processing tray to the escape position; and a sheet edge moving device for moving one edge of the sheet in a carrying direction on the carrying tray.

(9) Ninth Sheet Accommodating Device

A sheet accommodating device including:

a processing tray movable between a receiving position for receiving a sheet and an escape position, the sheet being aligned in the receiving position;

a carrying tray for carrying a sheet or sheet bundle moved by its own weight as a result of retreating of the processing tray to the escape position;

a first alignment reference surface for one edge of the sheet on the processing tray; and a second alignment reference surface for the same edge of the sheet on the carrying tray, the second alignment reference surface being shifted upstream in the sheet discharging direction from the first alignment reference surface.

(10) Tenth Sheet Accommodating Device

A sheet accommodating device including:

a processing tray movable between a receiving position for receiving a sheet and an escape position, the sheet being aligned in the receiving position; and a carrying tray for carrying a sheet or sheet bundle moved by its own weight as a result of retreating of the processing tray to the escape position, the carrying tray being configured to increase a distance between the carrying tray and the processing tray as the position moves downstream in the sheet discharging direction.

(11) Eleventh Sheet Accommodating Device

A sheet accommodating device including:

a processing tray movable between a receiving position for receiving a discharged sheet and an escape position, the sheet being aligned in the receiving position;

a carrying tray for carrying a sheet or sheet bundle moved by its own weight as a result of retreating of the processing tray to the escape position;

a sheet accommodating unit for accommodating the sheet;

a first transporting path for transporting the discharged sheet to the processing tray; and a second transporting path for transporting the discharged sheet to the accommodating unit, the second transporting path extending through an escape region of the processing tray.

Various features of the sheet accommodating devices described above may be appropriately employed in combination unless a particular disadvantage occurs.

Any one of the foregoing sheet accommodating devices may be combined with an image forming apparatus including an image forming unit forming an image on the sheet as well as a discharging portion for discharging the sheet bearing the image thus formed, and thereby may be used as a device for accommodating the sheets discharged from the image forming apparatus. The structures thus combined form a sheet processing system.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 21(A) is a schematic cross section of divided trays accommodated in a stacked fashion, FIG. 21(B) is a schematic cross section showing the divided trays located in sheet receiving positions, respectively, and FIG. 21(C) is a schematic plan showing a manner of moving the divided trays to the respective escape positions.

DESCRIPTION OF THE PREFERRED EMBODIMENTS

Then, specific examples of the sheet accommodating device as well as an example of the sheet processing device employing them will now be described with reference to the drawings.

Figure 1:
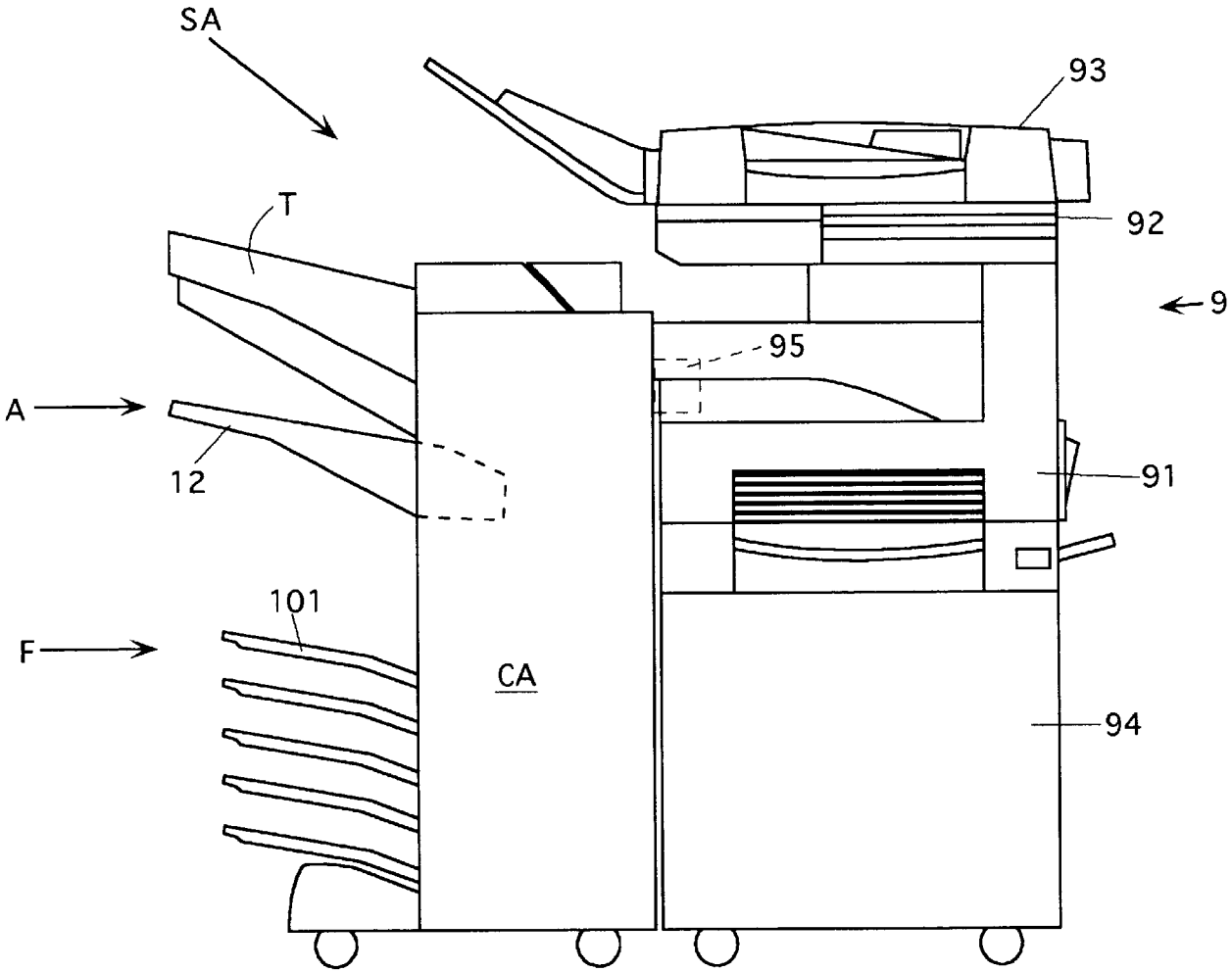
FIG. 1 is a schematic side view of an example of a sheet processing device coupled to an example of a sheet accommodating device according to the invention.
Figure 2:
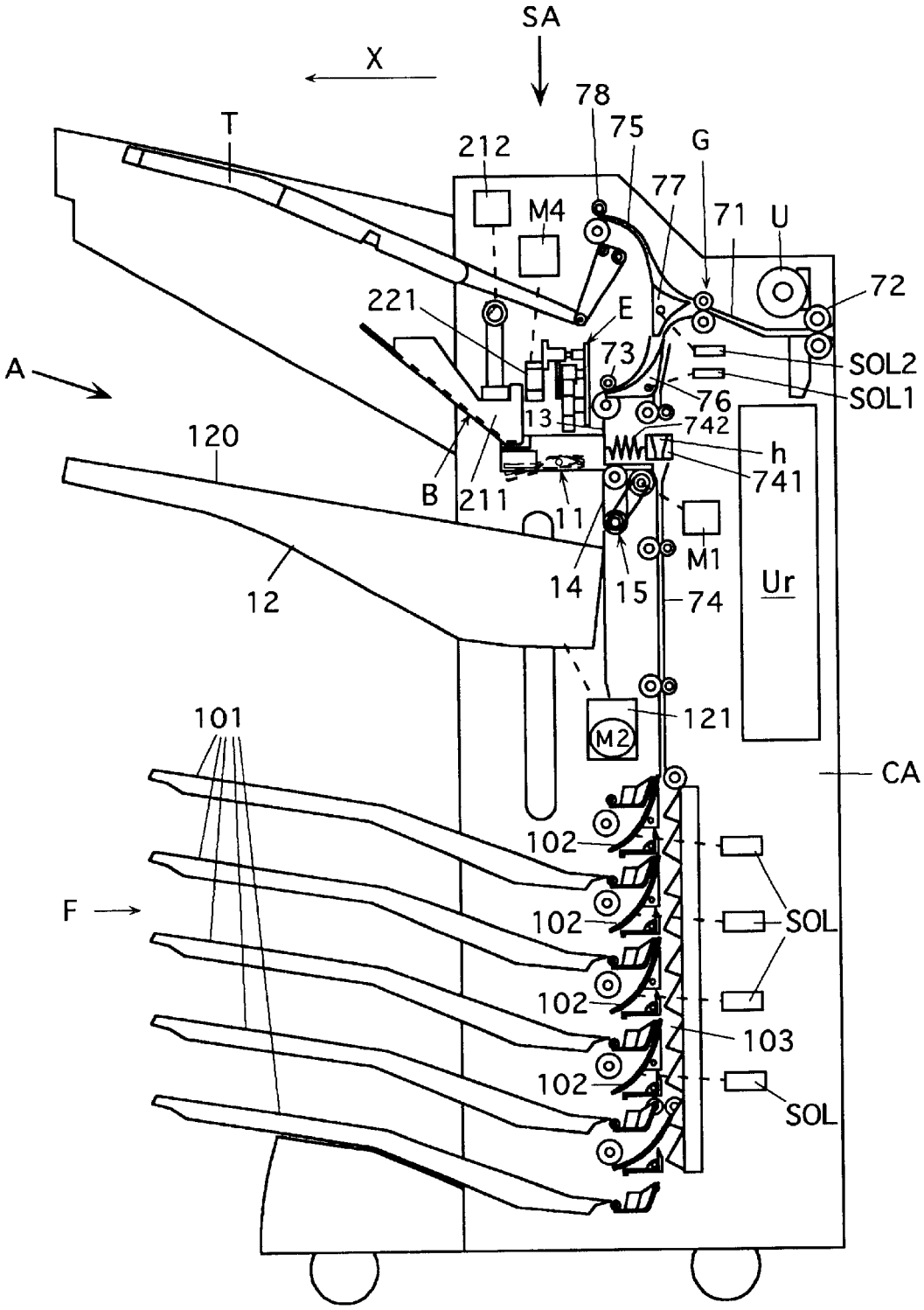
FIG. 2 is a schematic side view of an internal structure of the sheet accommodating device shown in FIG. 1.

FIG. 1 is a schematic side view of an example of an image forming apparatus connected to an example of a sheet accommodating device. FIG. 2 is a schematic side view of an internal structure of the sheet accommodating device shown in FIG. 1.

An image forming apparatus shown in FIG. 1 is a digital copying machine 9, and includes a print portion 91 (i.e., an image forming unit in this example) for forming an image corresponding to image information on a sheet in an electrophotographic manner, an image reading portion 92 for reading an original image, an automatic document feeder 93 which is arranged in an openable fashion on an document table glass (not shown) of the image reading portion 92, a sheet supply portion 94 arranged under the print portion 91, and a discharging portion 95 for discharging the sheet bearing the image formed by the print portion 91 to a sheet accommodating device SA.

In this copying machine 9, an original document is placed in the automatic document feeder 93, or is placed directly on the document table glass. The image reading portion 92 reads the image on the original document placed on the document table glass. The image information thus read is set to the print portion 91. The print portion 91 forms an image corresponding to the original image on the sheet sent from the sheet supply portion 94 in the known electrophotographic manner.

The sheet on which the image was formed as described above is discharged from the sheet discharging portion 95 of the copying machine 9 to the sheet accommodating device SA. The sheet processing device to which the sheet accommodating device of the invention is connected is not restricted to the copying machine, and may be, for example, a printer which performs the image formation based on image information sent thereto from an independent image reading device, a computer or the like, a facsimile or a composite device including one or more of these device.

The sheet accommodating device SA includes:

(1) a sheet-laid tray A which is a first sheet accommodating portion for carrying the sheets discharged from the copying machine 9;

(2) a first sheet transporting device (transporting and aligning device for sheet alignment in this example) B arranged for the sheet-laid tray A;

(3) a second transporting device (transporting and sorting device for sheet sorting in this example) C provided for the sheet-laid tray A;

(4) a stapler D which is an example of a stapler unit neighboring to an end of the processing tray 11;

(5) a sheet pushing device E for pushing the sheet on the processing tray 11;

(6) a guiding and pressing member 61, i.e., a pressing member also serving as a guide member for guiding the sheet toward the stapler D, and a biasing device 62 for the member 61;

(7) a sheet accommodating unit (mail bin device F in this example) which is a second sheet accommodating portion arranged under the sheet-laid tray A;

(8) an upper discharge tray T arranged above the sheet-laid tray A; and (9) a transporting device G for leading the sheet discharged from the sheet processing device (copying machine 9 in this example) to the sheet-laid tray A, mail bin device F or tray T.

Description is now given on the respective structures of the above (1)–(9).

(1) The sheet-laid tray A will now be described (see FIGS. 1 to 4).

The sheet-laid tray A is formed of the processing tray 11 and a sheet carrying tray 12 as shown in FIG. 2, although not restricted to this structure.

The processing tray 11 can reciprocate between a sheet receiving position P1 (see FIG. 3) for receiving a sheet S discharged from the sheet processing device (copying machine 9 in this example) and an escaped position P2 (see FIG. 3) retreated from the position P1. In the position P1, the processing tray 11 is used for sheet alignment, which will be described later, and predetermined post processing (i.e., sheet stapling in this example), if necessary.

The processing tray 11 is arranged substantially horizontal within a main casing CA of the sheet accommodating device SA, and can reciprocate between the positions P1 and P2 along a guide (not shown) in the same direction as a sheet discharging direction (which will be referred to as a "sheet discharging direction X", hereinafter) of the sheet processing device 9.

The processing tray 11 can be reciprocated by a drive portion, which reciprocates the tray 11 via a rack and pinion mechanism and a clutch coupled to the pinion. In this example, the drive portion is formed of a belt transmission device and a motor driving the same.

More specifically, a rack 111 is fixed to the under surface of the side of the processing tray 11, and is in mesh with a pinion gear 112. The pinion gear 112 is rotatably supported by the casing CA. The gear 112 is coupled to a shaft of a reversible motor M1 via a clutch 113 having a predetermined play. By driving the motor M1 in accordance with predetermined timing, the processing tray 11 is selectively located in the sheet receiving position P1 and the escaped position P2.

For retreating the processing tray 11 from the sheet receiving position P1 to the escape position P2, the motor M1 is driven in an appropriate direction. Thereby, the clutch 113 is engaged with a slight delay, and the processing tray 11 starts retreating. For moving the processing tray 11 from the escape position P2 to the sheet receiving position P1, the motor M1 is driven in the appropriate direction, and the clutch 113 is engaged with a slight delay so that the processing tray 11 starts moving to the position P1. The reason for providing the play in clutch 113 will be described later.

Figure 11:
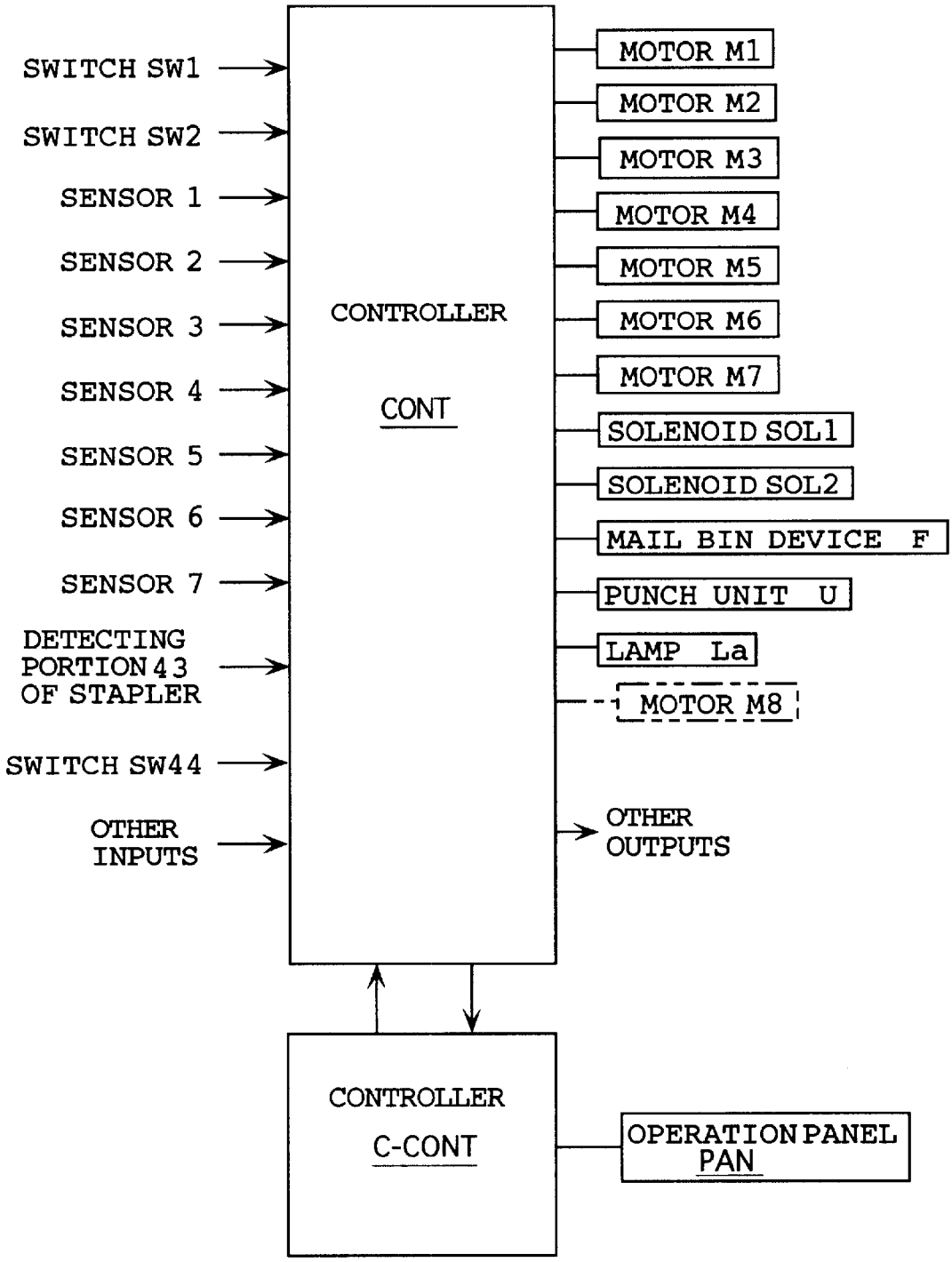
FIG. 11 is a block diagram showing a control circuit of the sheet accommodating device.

The motor M1 operates in accordance with an instruction sent from a controller CONT which controls the operation of the sheet accommodating device as shown in FIG. 11.

The controller CONT includes a computer, and can communicate with a controller C-CONT provided on the copying machine side for controlling the operation of the copying machine 9. If the sheet processing device is a printer, the controller CONT includes means which can communicate with a computer connected to the printer or the like.

An operation panel PAN in the copying machine 9 is also connected to the controller C-CONT on the copying machine 9 side. The operation panel PAN is provided with various keys such as a print key for instructing start of the copy operation, a ten-key pad for determining an intended number of copies, a selector key for sheet sizes, a key for instructing whether the sheets discharged to the sheet accommodating device SA after the image formation should be subjected to alignment and/or stapling or not, and a key for selecting the sheet-laid tray A, the mail bin device F or the upper tray T as a place in the sheet accommodating device for accommodating the sheet after image formation.

Various kinds of information is entered via the operation panel PAN, and the information relating to the operation control of the sheet accommodating device SA and others are sent to the controller CONT on the sheet accommodating device side.

Figure 4:
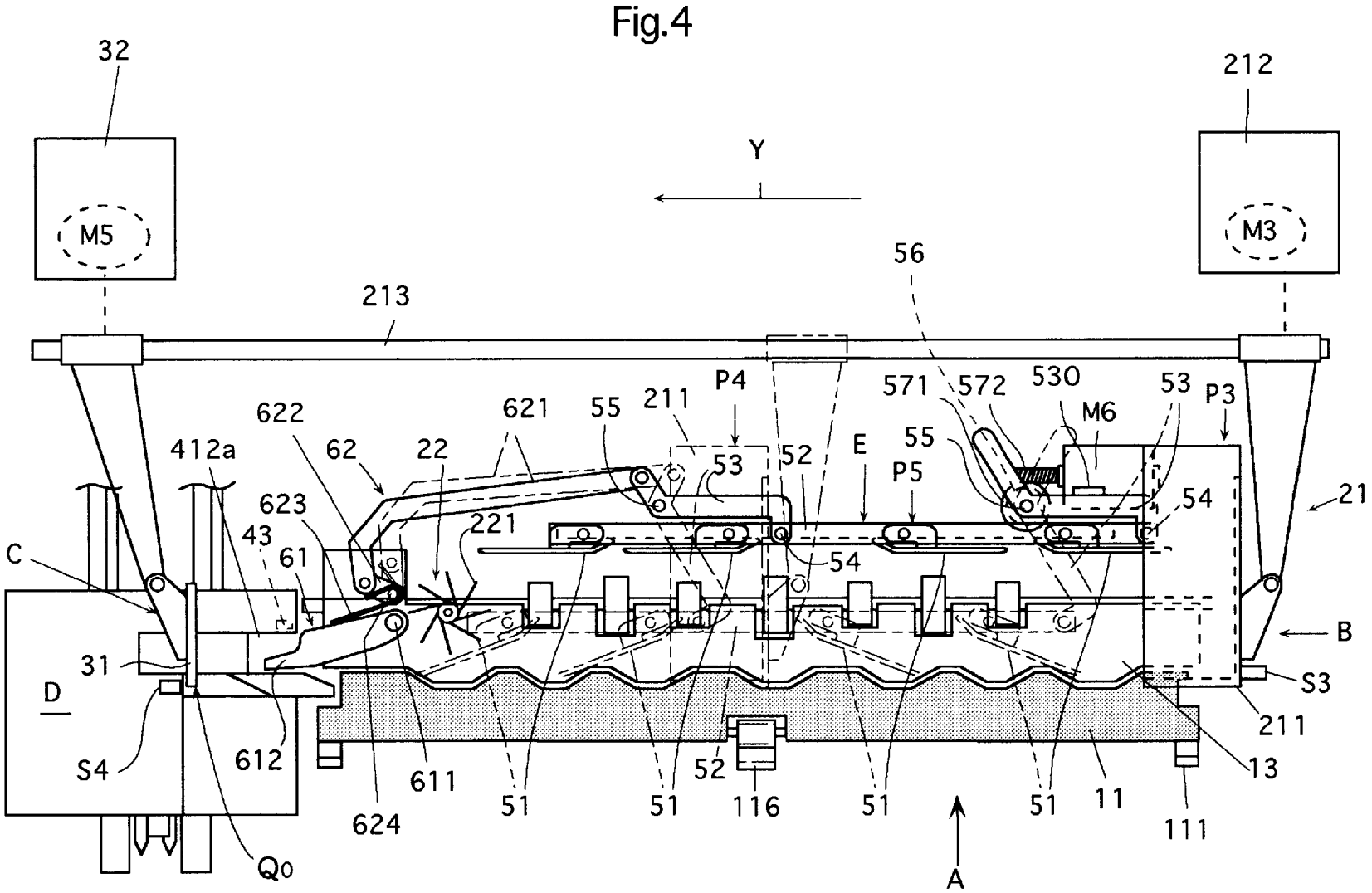
FIG. 4 is an elevation showing the processing tray as well as a transporting and aligning device, a sheet pushing device, a sorting device and others.

The processing tray 11 has stepped portions on the upper surface receiving the sheet in the front view, as shown in FIG. 4. In this example, the upper surface has a wavy section, and is formed of concave and convex portions. The purpose of this form is to reduce a frictional resistance between the upper surface of the processing tray and the sheet when the sheet is moved across (in this example, perpendicularly to) the sheet discharging direction on the processing tray for sheet alignment which will be described later.

The sheet carrying tray 12 is located under the processing tray 11 as shown in FIG. 2, and is vertically movable with respect to the sheet accommodating device casing CA. The sheet carrying tray 12 is moved to a predetermined vertical position in accordance with predetermined timing by a drive device 121, which includes a reversible motor M2 and a power transmission for transmitting the power of the motor M2 to the tray 12. The motor M2 operates in accordance with the instruction sent from the controller CONT.

The carrying tray 12 is inclined upward in the sheet discharging direction from the casing CA toward the tray distal end for preventing drop of the sheets laid thereon. In other words, the upstream end in the sheet discharging direction is located at a lowerer position than the downstream end.

A length of the tray 12 from the casing CA to the distal end is larger than the length of the processing tray 11 in the sheet discharging direction, and is large enough to support the whole sheet.

The carrying tray 12 is inclined as described above. The degree or extent of this inclination is related to the material and the irregularities of the upper surface of the tray, and is determined such that the sheets laid on the carrying tray 12 may not slide in the sheet discharging direction toward the alignment reference portion 14 (see FIG. 3).

Figure 15:
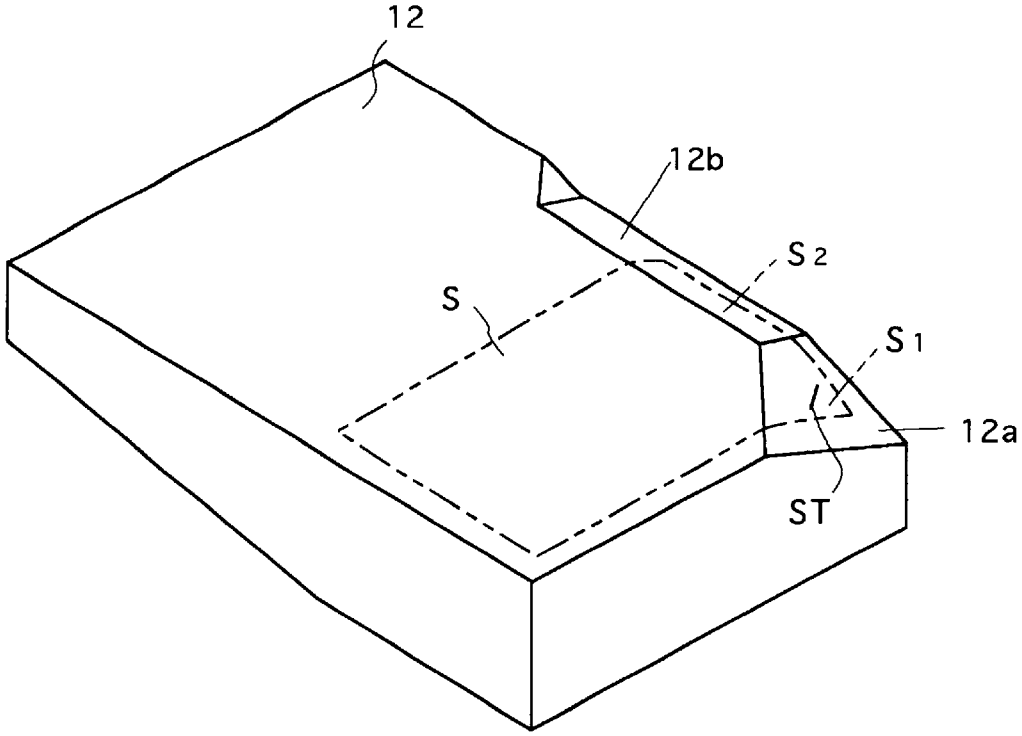
FIG. 15 is a schematic perspective view of a sheet-laid tray.

As can be seen only in a schematic perspective view of FIG. 15, the carrying tray 12 has concaved or recessed forms at portions 12*a* and 12*b* corresponding to corner portions $S_1$ nof the sheet S on the tray 12 stapled by a staple ST and sheet side portions $S_2$ continuing to the portions $S_1$, respectively. This suppresses such a disadvantage state that the portions $S_1$ of the sheets S stapled by the staple ST and the portions $S_2$ continuing thereto form partially raised portions on the carrying tray 12, and thereby disturb or impair the accommodation state of the sheet stack on the tray 12, even if these portions $S_1$ and $S_2$ have large thicknesses. Thus, the sheets can be smoothly accommodated in a stacked state.

Figure 3:
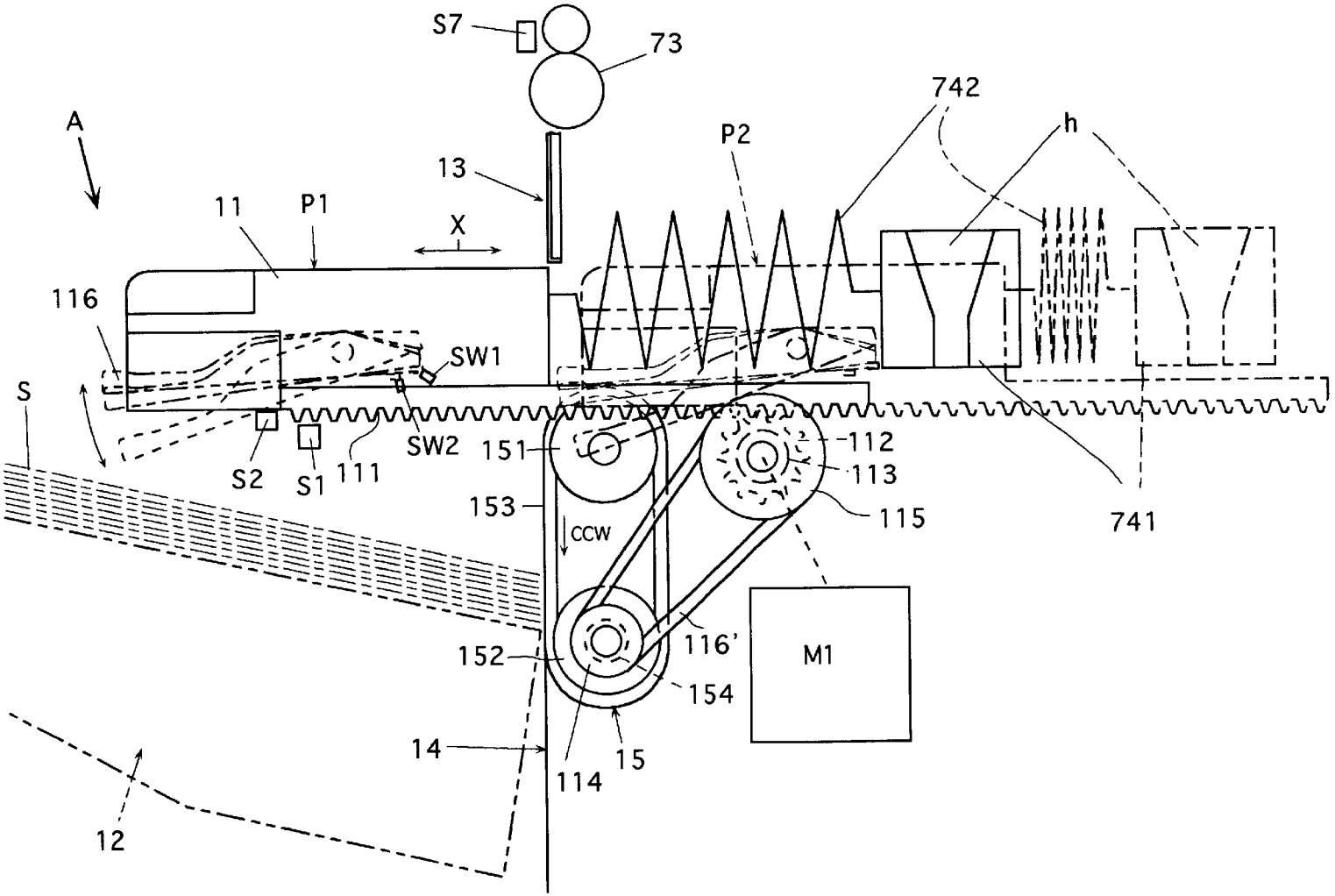
FIG. 3 is an enlarged side view of a processing tray and its peripheral portion.

As shown, e.g., in FIGS. 3 and 4, the processing tray 11 is provided at the center of the lower surface of its distal end with a vertically pivotable switch actuating member 116. Detectors (mechanical detector switches SW1 and SW2 in this example) are opposed to the member 116.

When the end of the actuating member 116 is raised by a predetermined distance, it actuates the switch SW1. When it is further raised, the member 116 actuates the switch SW2.

The switch SW1 is a rise-inhibiting switch for stopping the carrying tray 12 at the predetermined sheet receiving position. The switch SW2 is a rise-inhibiting switch (safety switch) for inhibiting further rise of the carrying tray 12.

The switches SW1 and SW2 are connected to the controller CONT for controlling the vertical movement of the carrying tray 12. The switches SW1 and SW2 are examples of a vertical position adjusting device for the carrying tray and a rise-inhibiting device of the carrying tray, respectively.

For the sheet-laid tray A, the structure is provided with the sheet alignment reference portion 13, which restricts the positions of the rear ends (upstream edges) in the sheet discharging direction of the sheets discharged onto the processing tray 11, and a sheet alignment reference portion 14, which restricts the positions of the rear ends (upstream edges) in the sheet discharging direction of the sheets laid on the carrying tray 12 (see, e.g., FIGS. 2 to 4).

The alignment reference portion 13 has a wall-like form extending along the front surface of the casing CA perpendicular to the sheet discharging direction, and extends vertically upward at a position above the rear end of the processing tray 11 arranged in the sheet receiving position.

The alignment reference portion 14 likewise has a wall-like form extending along the front surface of the casing CA perpendicular to the sheet discharging direction, and is arranged on the same surface as the alignment reference portion 13. The alignment reference portion 14 is located under the processing tray 11, and extends downward and substantially perpendicularly to the upper surface of the carrying tray 12 (in other words, the surface of the sheet laid thereon). The alignment reference portion 14 extends relatively downward beyond the rear end of the upper surface of the carrying tray 12, which is arranged for receiving the sheets from the processing tray 11.

The alignment reference portion 14 is partially formed of a sheet edge (rear edge, in this example) moving device 15.

The sheet edge moving device 15 includes an endless belt 153 which is retained around upper and lower pulleys 151 and 152, and forms a portion of the alignment reference portion 14. A driven pulley 114 is connected to the lower pulley 152 via a one-way clutch 154, and a drive pulley 115 is arranged on the shaft of the motor M1. An endless belt 116' is retained around the pulleys 114 and 115.

Owing to the above structure, when the motor M1 operates to retreat the processing tray 11 from the sheet receiving position P1 to the escape position P2, the one-way clutch 154 is not engaged, and the belt 153 does not turn so that only the processing tray 11 moves toward the escape position P2. When the motor M1 operates in the opposite direction to move the processing tray 11 from the escape position P2 to the sheet receiving position P1, the clutch 154 is engaged at the same time as the start of the motor M1. Therefore, the endless belt 153 starts the rotation in a counterclockwise direction CCW in FIG. 1, and then the processing tray 11 starts the movement to the position P1 with a slight delay.

A tray indicated by a reference number "16" in FIG. 12 and others is a side tray, and will be described later in connection with the operation of the sheet accommodating device SA.

(2) The first sheet transporting device (in this example, a transporting and aligning device for sheet alignment) B provided for the sheet-laid tray A will now be described (see FIGS. 2, 4–7, 12–14 and others).

The transporting and aligning device B is provided for moving the sheets, which are discharged from the sheet processing device (i.e., the copying machine 9 in this example) and are laid on the sheet-laid tray A, along the tray A toward the predetermined position (i.e., the predetermined alignment reference position $Q_0$ (see FIG. 4) in this example). The transporting and aligning device B includes a first transporting device (i.e., first transporting and aligning device 21 for sheet alignment) and another transporting device (i.e., second transporting and aligning device 22 for sheet alignment).

The first transporting and aligning device 21 includes a first transporting and aligning member 211, which is in contact with one side edge of the sheet discharged onto the processing tray 11 of the sheet-laid tray A located in the position P1, and moves the sheet along the processing tray 11 toward the alignment reference position $Q_0$ on the opposite side. The first transporting and aligning device 21 also includes a drive device 212 for driving the transporting member 211 in the above manner.

The transporting member 211 has a home position P3 in one side region with respect to an intermediate position defined by the initial position on the sheet-laid tray A in which the sheet discharged from the copying machine 9 is located, and more specifically, with respect to an intermediate position defined by the above initial position in the processing tray 11 of the tray A. In this example, the transporting member 211 is formed of a plate having a plate surface which can push and move the sheets.

The transporting member 211 is supported for reciprocation along a guide shaft 213 extending in a direction Y perpendicular to the sheet discharging direction X.

The drive device 212 includes a motor M3 and a transmission device for transmitting a power of the motor M3 to the transporting member 211.

The transporting member 211 driven by the motor M3 can reciprocate in accordance with predetermined timing between the home position P3 and a sheet passing position P4, which is defined in accordance with the sheet size for passing or transferring the sheet to a second transporting member 221 described later. The transporting member 211 also operates for the sorting operation which will also be described later.

The motor M3 operates based on the instruction sent from the controller CONT.

The second transporting and aligning device 22 includes the second transporting and aligning member 221, which comes into contact with the surface of the sheet transferred from the first transporting device 21, and rotates to move the sheet to the alignment reference position. The second transporting and aligning device 22 includes a rotary drive device for the member 221, a second transporting member retreating device for retreating the member 221 to the escape position spaced from the sheet, a device for biasing the second transporting member 221 and a device for keeping a constant distance between the rotation center of the second transporting member 221 and the sheet surface.

The second transporting member 221 may be selected from various types of members, which can come into contact with the sheet and rotates for transporting the sheet, and may be, e.g., an elastic roller having a surface portion made of an elastic material. For stably and reliably transporting the sheet, the second transporting member 221 in this example is formed of a rotary paddle provided with flexible paddles, which are arranged radially around a rotation axial and are made of an elastic material.

The rotary paddle 221 is arranged in a position above the processing tray 11 shifted from said sheet initial position toward the alignment reference position $Q_0$. More specifically, the rotary paddle 221 is arranged in the position which can avoid collision with the sheet when the sheet is discharged from the copying machine 9 onto the sheet-laid tray A. Thereby, the sheet accommodating device SA can efficiently accommodate the sheets.

Figure 5:
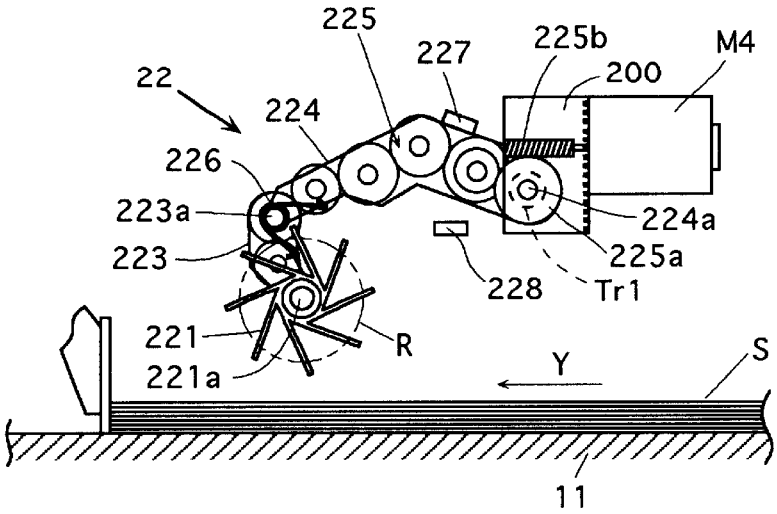
FIG. 5 is an elevation of a rotary paddle and a drive device thereof in a sheet non-transporting state.
Figure 6:
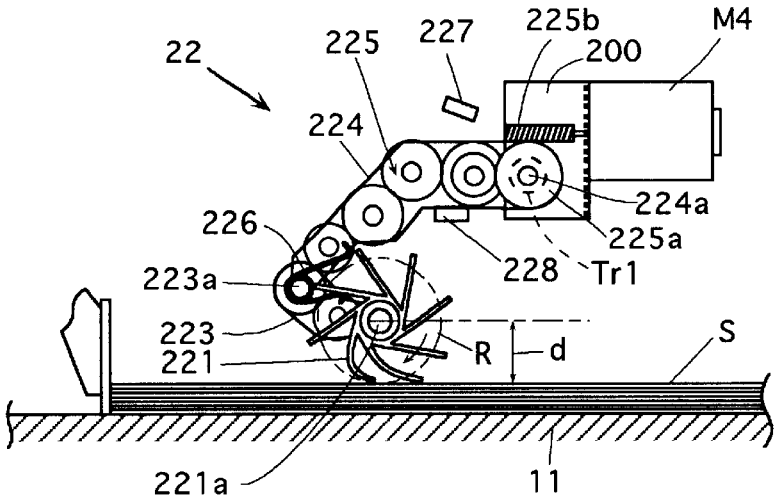
FIG. 6 is an elevation of the rotary paddle and the drive device thereof in a sheet transporting state.
Figure 7:
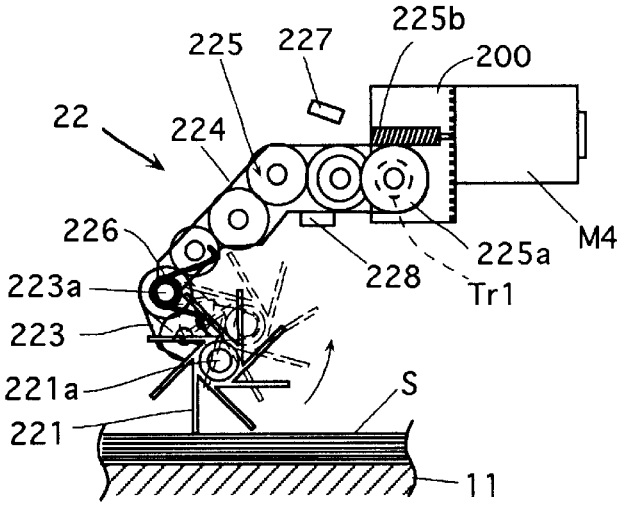
FIG. 7 shows an escaping operation of the rotary paddle.

As shown in FIGS. 5 to 7, the rotary paddle 221 is fixed to a paddle shaft 221*a*, which is rotatably carried on an end of a lower arm 223. The shaft 221*a* rotatably carries a pitch ring R having an outer diameter smaller than that of the rotary paddle. The pitch ring R is provided for maintaining a constant distance d (see FIG. 6) between the center of the rotary paddle and the upper surface of the sheet S to be aligned on the processing tray 11.

The lower arm 223 is rotatably coupled to an end of an upper arm 224 via a shaft 223*a*. The shaft 223*a* is rotatable with respect to these arms. The other end of the upper arm 224 is rotatably coupled to a support member 200 in the fixed position via a shaft 224*a*. The shaft 224*a* is rotatable with respect to the support member 200 and the arm 224.

Owing to the above structure, the upper arm 224 can pivot around the shaft 224*a* to raise or lower its one end, and the lower arm 223 can pivot around the shaft 223*a* to raise or lower its one end relatively to the arm 224. Owing to these operations, the paddle 221 and the pitch ring R can vertically move with respect to the arm 224.

The arm coupling shaft 223*a* form a so-called "revolution axis" of the rotary paddle 221, and is located downstream in the sheet transporting and aligning direction Y from the rotary paddle shaft 221*a* which is a so-called "rotation axis" of the rotary paddle 221.

A spring 226, which biases the lower arm 223 downward and is used as a biasing device for biasing the rotary paddle 221 toward the sheet to be transported for alignment, is arranged around the arm coupling shaft 223*a* and between the lower and upper arms 223 and 224.

The arms 223 and 224 carry a gear train 225 including gears of which gear shafts are formed of the shafts 221*a*, 223*a*, 224*a* and other shafts, respectively. More specifically, a gear 225*a* arranged on the shaft 224*a* is in mesh with a worm gear 225*b*, which can be reversibly driven by a motor M4 arranged in a stationary position.

A reversible torque limiter Tr1 is interposed between the gear 225*a* and the upper arm 224.

According to the second transporting and aligning device 22 described above, when the motor M4 operates to raise the arm 224, it can rotate clockwise in FIG. 5 the gear 225*a* on the end of the upper arm 224 via the worm gear 225*b*. Thereby, the upper arm 224 and therefore the lower arm 223 can be raised. Consequently, the rotary paddle 221 can be raised from the position for the sheet transportation to the escape position. This paddle escape position is defined by an upper stop 227 which can be in contact with the upper arm 224. When the upper arm 224 comes into contact with the upper stop 227, the torque limiter Tr1 operates so that breakage of members is prevented.

When the motor M4 operates to lower the arm 224, it also rotates counterclockwise in FIG. 6 the gear 225*a* on the end of the upper arm 224 via the worm gear 225*b*. Thereby, the upper arm 224 and therefore the lower arm 223 can be lowered. Consequently, the rotary paddle 221 can be located in the position for sheet transportation. When the upper arm 224 comes into contact with the lower stop 228, the torque limiter Tr1 operates so that the arms are prevented from further lowering and therefore breakage. However, the motor M4 continues the operation so that it further drives the gear train 225, and the rotary paddle 221 is driven to rotate in the sheet transporting and aligning direction. The motor M4 operates in accordance with the instruction sent from the controller CONT.

The rotary paddle 221 is driven such that the sheet transporting speed achieved by the paddle 221 is larger than the sheet transporting speed achieved by the first transporting and aligning member 221. Thereby, when the sheet transported by the first transporting member 221 is passed to the paddle 221, the sheet is pulled by the paddle 221 so that it is possible to prevent strong collision between the sheet and the paddle, compression buckling of the sheet and therefore damages such as wrinkles.

When the rotary paddle 221 located in the sheet transporting position comes into contact with the sheet S to be transported and aligned, the pitch ring R also comes into contact with the upper surface of the sheet so that the distance d is maintained constant between the upper surface of the sheet and the rotation center of the rotary paddle 221. Owing to this, the degree of deformation of the rotary paddle 221 can be constant, and the transporting power of the rotary paddle 221 can be constant.

Since the rotary paddle 221 is biased toward the sheet by the biasing spring 226, this allows such a state that the sheets are transported and aligned by a constant transporting force without an influence by an amount of the carried sheets.

Since the rotation shaft 221*a* of the rotary paddle 221 is located upstream in the sheet transporting direction with respect to the revolution shaft 223*a*, the paddle 221 can revolve toward an escape position around the revolution shaft 223*a* as shown in FIG. 7 even when the paddle 221 receives a reaction moment from the sheet surface as a result of the rotation for sheet transportation. Accordingly, the paddle 221 is prevented from being engaged into the sheet so that the sheet can be transported more safely and smoothly.

As a device for maintaining the constant distance between the rotation axis of the second transporting member and the sheet surface, the structure may employ an electrical mechanism or an electrical and mechanical mechanism provided with a sensor in addition to the pitch ring R. This sensor is employed for determining a distance between the rotation center of the second transporting member and the sheet surface. Based on the distance determined by the sensor, the above distance is maintained constant by controlling the extent of lowering of the second transporting member caused by the downward rotation of the upper and lower arms 223 and 224.

(3) The second transporting device (the transporting and sorting device for sheet sorting in this example) C provided for the sheet-laid tray A will now be described (see FIGS. 4, 12–14 and others).

This transporting and sorting device C is provided for selectively moving the sheets, which are aligned in the alignment reference position $Q_0$ by the transporting and aligning device B, to the first and second positions Q1 and Q2 (see FIGS. 12 to 14) on the sheet-laid tray A.

The transporting and sorting device C includes an alignment reference member 31 having a home position in a region, which is opposite to the first transporting and aligning member 211 with the initial position of the sheet on the sheet-laid tray A therebetween, and thus is on the same side as the alignment reference position $Q_0$. The transporting and sorting device C also includes a drive device 32 for driving the member 31. The home position of the alignment reference member 31 is coincident with the alignment reference position $Q_0$.

The alignment reference member 31 is supported for reciprocation along the guide shaft 213 extending in the direction Y perpendicular to the sheet discharging direction X. The member 31 is formed of a plate having a plate surface, which can come into contact with the sheets for aligning them. This plate surface can push and move the sheet(s) from the alignment reference position $Q_0$ to the first or second position Q1 or Q2.

The drive device 32 includes a motor M5 and a transmission device for transmitting the power of the motor M5 to the member 31.

The member 31 driven by the motor M5 can reciprocate in accordance with predetermined timing between the home position (alignment reference position) $Q_0$ and the first or second position Q1 or Q2. The motor M5 operates in accordance with the instruction sent from the controller CONT.

(4) The stapler D opposed to one side of the processing tray 11 will now be described (see FIGS. 4, 8–10, 12–14 and others).

This stapler D forms a sheet post-processing device together with the processing tray 11 of the sheet-laid tray A and the casing CA of the sheet accommodating device SA. The stapler D is an example of the post-processing unit. The stapler D includes a sheet aligning portion having a space for sheet alignment.

These will now be described in greater detail.

Figure 8:
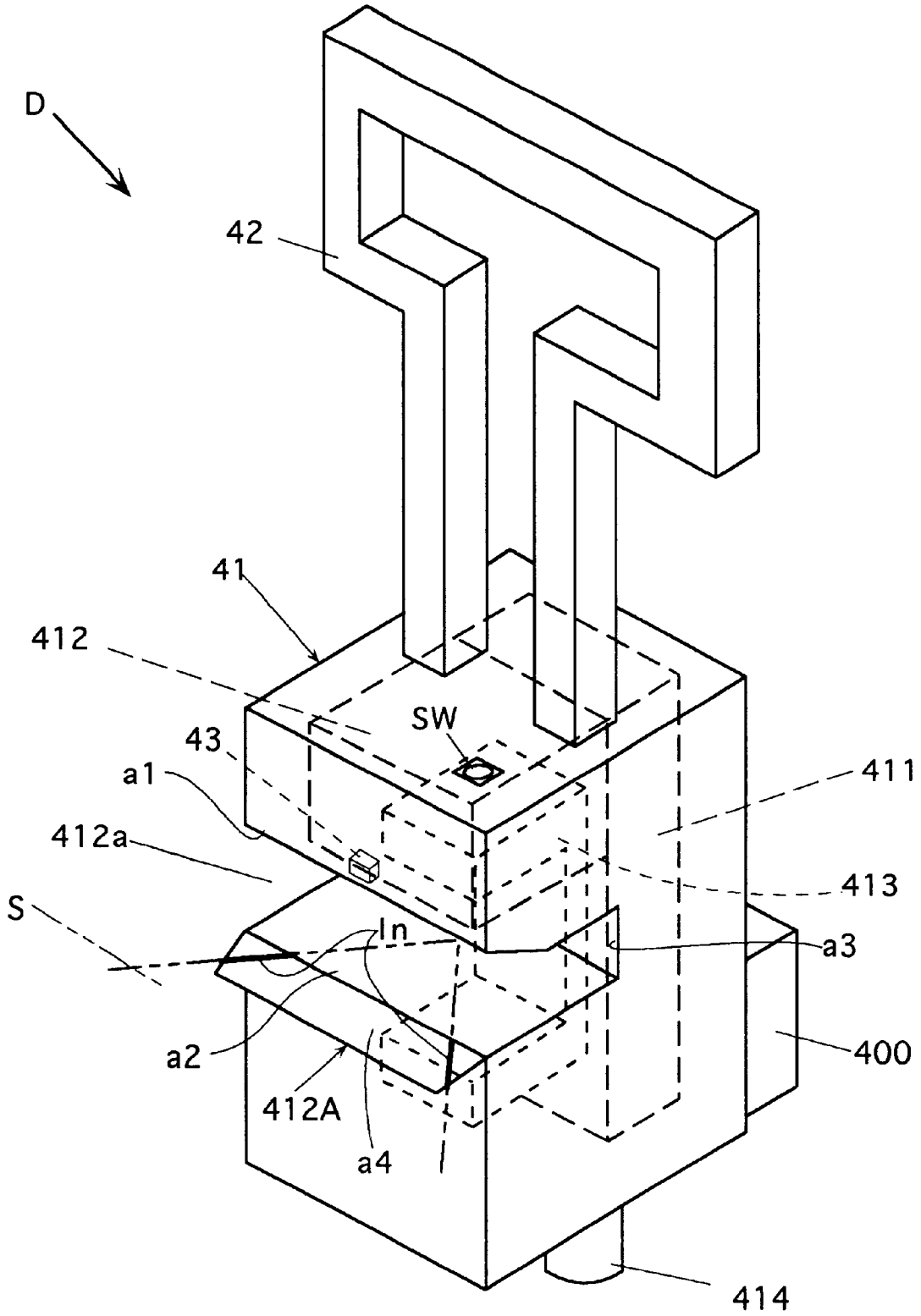
FIG. 8 is a perspective view of a stapler.
Figure 9:
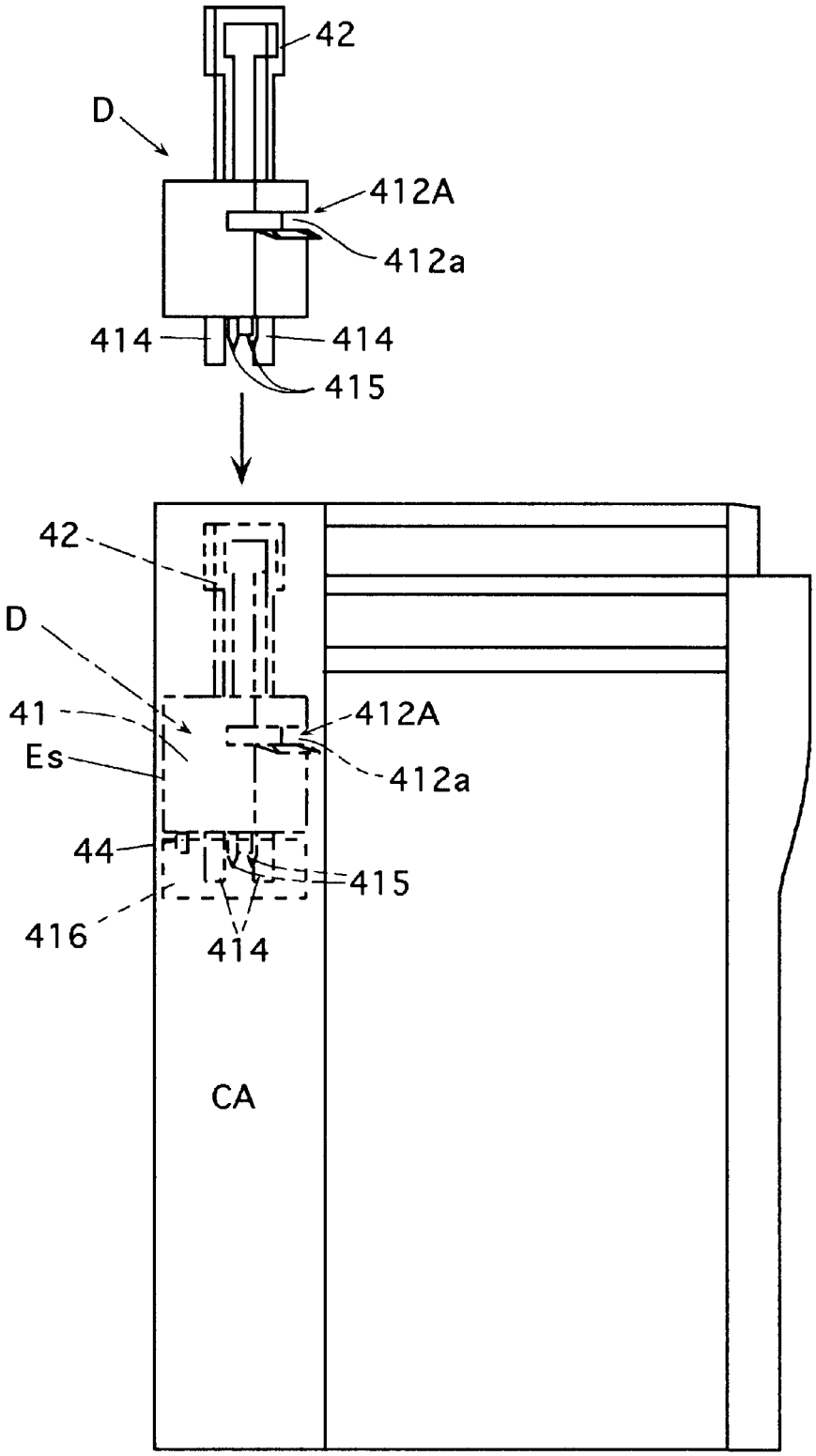
FIG. 9 shows a manner for attaching the stapler to a sheet accommodating device.
Figure 10:
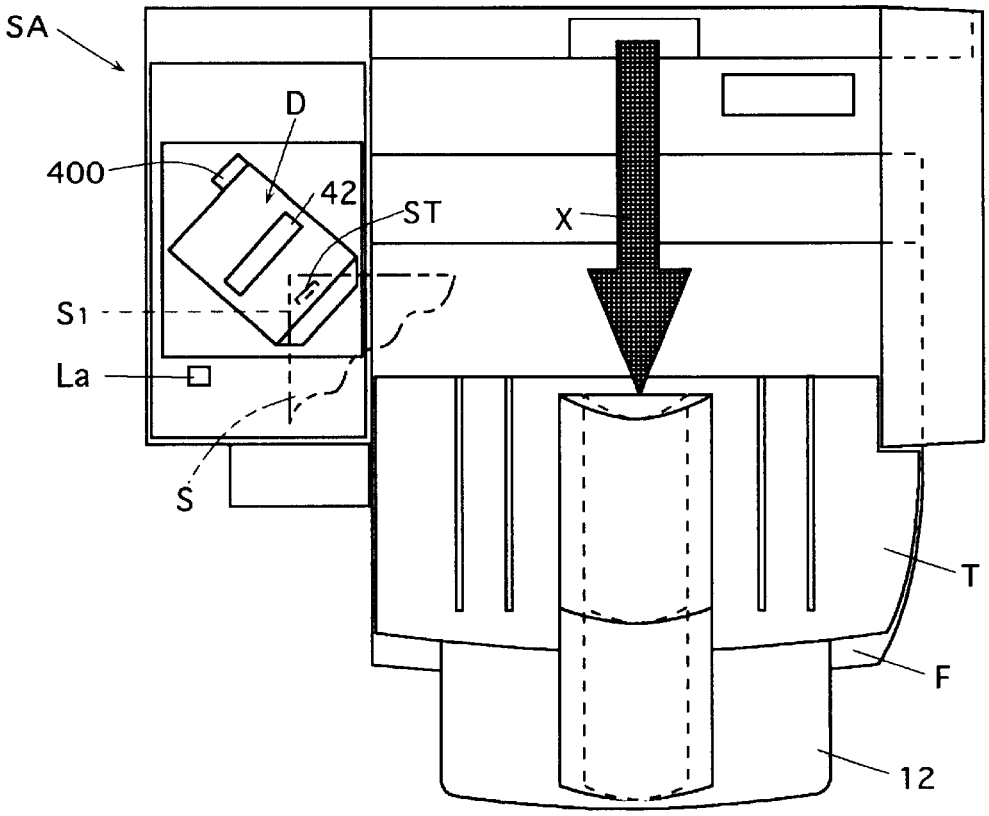
FIG. 10 is a plan showing the stapler attached to the sheet accommodating device.

The stapler D has a main body 41 of a block form as shown in FIGS. 8 and 9, and is also provided with a handle 42 projected upward from the body 41.

The main body 41 is provided with a staple holder 411 which can hold staples to be consumed, and also allows exchange, addition and others of the staples. The main body 41 is also provided with a post-processing portion 412 for binding the sheet bundle with the staple, and an electric power source 400 for the post-processing portion 412. A manual switch SW for activating the post-processing portion 412 is arranged on the upper surface of the body 41. An attachment pin 414 and an electric plug 415 are arranged on the lower surface of the body 41 (see FIG. 9).

The post-processing portion 412 includes a portion 412A forming a space 412*a*, into which portions of the sheets to be bound are inserted. The space 412*a* serves also as the space for sheet alignment, and the portion 412A serves also as the sheet aligning portion.

The space 412*a* is surrounded by top and bottom surfaces a1 and a2 opposed to each other as well as a rear surface a3.

A sheet leading shelf a4 continuing to the bottom surface a2 is provided with indexes In for smoothly leading and aligning the sheets in the post-processing position (staple position in this example) in the space.

The main body 41 is also provided with a detecting portion 43 for detecting the fact that sheet is located in the post-processing position within the space 412*a*. Thereby, stapling without the sheet can be prevented. The post-processing portion 412 can perform the stapling only when the detecting portion 43 detects the sheet.

In FIG. 9, the handle 42 is held and the stapler D is fitted downward into a stapler space Es in the sheet accommodating device case CA, whereby the stapler D can be firmly fixed to the sheet accommodating device SA. The stapler D thus fitted can be removed upward, if necessary. Usually, the stapler D is in the fitted state.

When the stapler D is arranged in the space Es, the attachment pin 414 and the electric plug 415 are connected to a connector portion 416 in the bottom of the space Es. In this state, the power source 400 is charged. The stapler D thus fitted is opposed to the one side of the processing tray 11, and the aligning portion 412A is positioned such that the aligning portion 412A can align one of the corners on the rear end of the sheets, which are in contact with and are aligned by the alignment reference member 31 arranged in the alignment reference position $Q_0$. A display device (a lamp La (see FIG. 10) arranged in the casing CA in this example) for displaying the fact that the stapler D is fitted is turned on in the above fitted state. The lamp La is turned on when the switch 44 arranged within the space Es is activated by the main body 41 (see FIG. 9).

The detecting portion 43 as well as the lamp La and the switch 44 are connected to the controller CONT.

The stapler D fitted in the space Es of the casing CA can bind the sheets, which are discharged from the copying machine 9 onto the sheet-laid tray A and are aligned.

The stapler D can be removably attached into the casing space Es of the sheet accommodating device SA. Therefore, maintenance such as exchange and supply of the staples as well as repair, routine inspections and others can be easily performed by removing the stapler D from the casing space Es.

The stapler D can be removed from the sheet accommodating device SA. When removed, the stapler D can be used independently of the sheet accommodating device in a convenient manner. When used in a removed state, it can be powered by the power source 400, and the manual switch SW can be used for the stapling operation.

When used in a removed state, the sheet insertion indexes In can be utilized for inserting the sheets into the sheet aligning space 412*a*.

(5) The sheet pushing device E for pushing the sheets on the processing tray 11 will now be described (see FIG. 4).

The sheet pushing device E includes a plurality of (four, in this example) pushing members 51 for pushing the rear ends (upstream ends in the sheet discharging direction X) of the sheets, which are discharged from the copying machine 9 to the sheet-laid tray A and are laid on the processing tray 11, toward the tray 11, as shown in FIG. 4.

Each pushing member 51 is supported by a horizontal rod 52 extending in the sheet transporting and aligning direction. The rod 52 has the opposite end portions which are rotatably connected to the one ends of a pair of parallel arms 53 via a shaft 54, respectively. A portion of each arm 53 which is slightly spaced from the other end is rotatably coupled via a shaft 55 to a member (not shown) arranged at a stationary position.

In an elevation or front view of FIG. 4, the shaft 55 on the arm 53 in the right position is fixed to the arm 53, and is coupled to a gear 571 via a torque limiter 56 operating in the opposite directions. The gear 571 is in mesh with a worm gear 572 which is driven by a reversible motor M6.

When the motor M6 operates in accordance with the predetermined timing, it drives a link mechanism formed of a pair of arms 53, a horizontal rod 52 and others so that the pushing member 51 can rise and lower between a raised escape position P5 depicted by solid line in FIG. 4 and a lower sheet pushing position for pushing the sheet. In the position P5, the right arm 53 is in contact with the an upper stop 530.

Whenever the sheet discharged from the copying machine 9 is laid on the sheet-laid tray A (processing tray 11), the pushing member 51 is arranged in the sheet pushing position prior to the start of the operation of transporting and aligning the sheet by the transporting and aligning device B. Thereby, the rear end of the sheet is pushed onto the processing tray 11 so that even the curled sheet is straightened to attain the state allowing accurate and easy alignment. After the alignment of the sheet, the member 51 retreats to the escape position P5.

The motor M6 is connected to the controller CONT, and operates in accordance with the instruction sent from the controller CONT.

Each pushing member 51 has a lever-like form. The two pushing members 51 on the left side in the front view are rotatably coupled at their right portions to the horizontal rod member 52 via pins. When these two members 51 lower from the escape position P5, they inclines under their own weights so that their left ends are located in the lower positions as depicted by alternate long and short dash line in FIG. 4. In the front view, the two pushing members 51 on the right side are rotatably coupled at their left portions to the horizontal rod member 52 via pins. When these two members 51 lower from the escape position P5, they inclines under their own weights to locate their right ends in the lower positions as depicted by alternate long and short dash line in FIG. 4.

In the raised escape position P5, the two pushing members 51 on the left side are substantially located in horizontal positions by the stationary stops (not shown) which are in contact with the right ends thereof, respectively. The two pushing members 51 on the right side are substantially located in horizontal positions by the stationary stops (not shown) which are in contact with the left ends thereof, respectively. Further, the right arm 53 is in contact with the upper stop 530. Thereby, the torque limiter 56 operates to avoid damages of the members.

When each pushing member 51 is moved from the escape position P5 to the sheet pushing position and comes into contact with the sheet on the processing tray 11, it pushes the sheet S toward the processing tray 11. Further, the foregoing link mechanism operates to move the sheet slightly in the sheet transporting and aligning direction Y toward the alignment reference position $Q_0$.

More specifically, when each pushing member 51 in this example lowers from the escape position P5 to the sheet pushing position, it inclines during the lowering, and then starts to come into contact with the sheet on the processing tray 11. When it further lowers, the pushing member 51 receives a reaction force from the sheet so that it turns toward the horizontal position, and pushes the sheet S toward the processing tray 11. At the same time, the link mechanism slightly moves with respect to the processing tray 11 in the transporting and aligning direction Y to move the sheet in the sheet transporting and aligning direction Y toward the alignment reference position $Q_0$. The inclined direction of the two pushing members 51 on the left side is different from that of the two pushing members 51 on the right side so that the members on the opposite sides substantially diverge downward in the front view. Accordingly, when these members 51 come into contact with the sheet, they act on the sheet to expand the sheet laterally while pushing the sheet toward the processing tray 11, and also move slightly the sheet in the transporting and aligning direction.

The sheet pushing force applied by the pushing members 51 increases as the pushing members 51 lower toward the sheet. However, this pushing force is restricted to a predetermined force by the torque limiter 56, which is interposed between the shaft 55 of the arm 53 on the right side in the link mechanism and the drive gear 571. More specifically, the pushing force is restricted to an extent, which allows the operation of transporting and aligning the sheet while the sheet is being pushed by the pushing members 51.

(6) Description will now be given on the sheet guiding and pressing member 61, i.e., the pressing member also serving as the guide member for guiding the sheets toward the stapler D as well as the biasing device 62 for the member 61 (see FIG. 4).

As shown in FIG. 4, the sheet accommodating device includes the guide member 61 for guiding the leading end, in the moving direction, of the sheet, which is moved by the transporting and aligning device B toward the alignment reference position $Q_0$, into the space of the aligning portion. Generally, the aligning portion is not particularly restricted if it can be used for alignment. The space in the aligning portion is merely required to have a predetermined size in the sheet stacking direction (e.g., the vertical direction). In this example, the aligning portion is formed of an aligning portion 412A in the post-processing portion 412 of the stapler D, and the space is formed of the space 412*a* in the aligning portion 412A, into which the portions of the sheets to be stapled (i.e., the rear corner portion in the sheet moving direction) are inserted.

The guide member 61 in this example is formed of a lever-like member, and serves as the pressing member for the sheets. In the moving direction Y of the sheet on the processing tray 11 moved by the transporting and aligning device B, the guide member 61 is located upstream to the aligning portion 412A of the stapler D, and is opposed to the aligning portion space 412*a*.

The guiding and pressing member 61 is coupled at its upstream end, in the sheet transporting and aligning direction Y, to a stationary member (not shown) via a shaft 611 so that it can swing to raise and lower its downstream end 612 (i.e., an end on the aligning side) of the member 61.

The sheet accommodating decice is also provided with the device 62 for biasing the guide member 61 in the sheet pressing direction.

The biasing device 62 includes two rods 621 and 622 connected to the left arm 53 in FIG. 4, which forms a link mechanism for raising and lowering the pushing members 51, and a torsion coil spring 623 for biasing the guide member 61 in the sheet pressing direction.

One end of the longer rod 621 is rotatably connected to the other end (upper end in FIG. 4) of the arm 53 via a pin, and the other end of the rod 621 is rotatably connected to one end of the shorter rod 622 via the pin. The other end of the rod 622 is rotatably coupled to a stationary member (not shown) via a shaft 624.

The spring 623 is arranged between the rod 622 and the guiding and pressing member 61, and always biases the guiding and pressing member 61 in the sheet pushing direction.

As shown by the solid line in FIG. 4, when the pushing member 51 is in the upper and therefore retreated escape position P5, the rods 621 and 622 in the biasing device 62 are moved leftward and downward in FIG. 4 by the left arm 53 in the link mechanism for vertically moving the pushing members 51 so that the spring 623 is in the position applying a large spring force. The spring 623 in this state strongly biases the guide member 61 in the sheet pressing direction. When the corner portion of the leading end of the sheet is already located in the aligning portion space 412*a*, the guiding and pressing member 61 strongly presses and thereby straightens the corner portion even when the corner portion is curled. Thereby, the space above the sheet in the aligning portion space 412*a* can be increased as large as possible for easy reception of the next sheet. Owing to the pressing, the stapling by the stapler can be performed easily and accurately.

For aligning the sheet which is discharged from the copying machine 9 and is laid on the processing tray 11, the pushing members 51 push the rear end of the sheet, and therefore are located in the sheet pushing position. In this state, the rods 621 and 622 in the biasing device 62 are moved rightward and upward in FIG. 4 by the left arm 53 in the link mechanism for raising and lowering the pushing members 51. Thereby, the elastic force of the spring 623 is reduced, and the sheet pressing force by the guiding and pressing member 61 is reduced so that the members 51 can safely guide the sheet, which is transported for alignment, into the aligning portion space 412*a*.

The pushing members 51 of the sheet pushing device E conduct the sheet pushing operation on every sheet so that the guiding and pressing member 61 conducts the sheet guiding and pushing (pressing) operation on every sheet.

The biasing device 62 can also be considered as an example of the device, which appropriately sets the pressing force of the guiding and pressing member 61 in combination with the operation of the pushing members 51, and more specifically when the pushing memberes 51 are pushing the sheet, the biassing device 62 sets the pressing force of the member 61 applied to the sheet to be smaller than the pressing force which is applied when the members 51 are not pushing the sheet.

Figure 16:
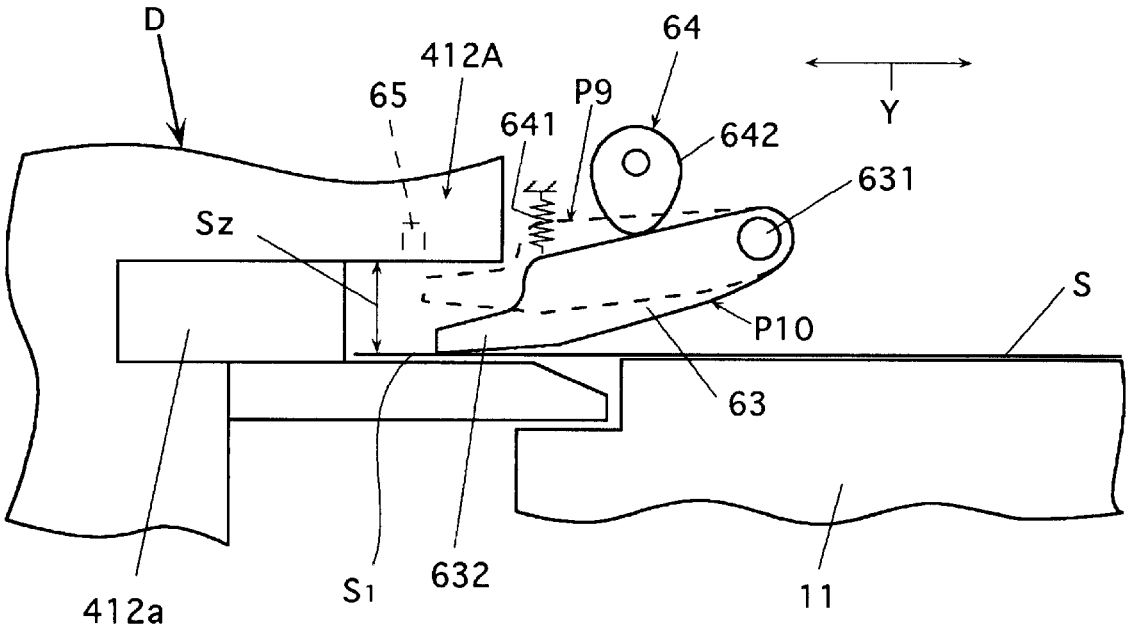
FIG. 16 shows another example of sheet guidance to an aligning portion.

A member which is dedicated to the sheet guidance and is schematically shown in FIG. 16 may be employed instead of or together with the guiding and pressing member 61.

The guide member 63 shown in FIG. 16 has a lever-like form, and is located upstream to the aligning portion 412A of the stapler D in the moving direction Y of the sheet on the processing tray 11 moved by the transporting and aligning device B, and is opposed to the aligning portion space 412*a*.

The guide member 63 can move between the sheet guide position (raised position) P9, where the leading portion (downstream end) $S_1$ of the sheet S moved by the transporting and aligning device B is guided to the aligning portion space 412*a*, and the sheet pushing position (lowered position) P10 shifted toward the sheet-laid tray A (processing tray 11). In the sheet pushing position P10, the sheet is pushed toward the tray A. This movement is achieved by the guide member moving device 64.

The upstream end, in the sheet transporting and aligning direction, of the guide member 63 is coupled via a shaft 631 to a stationary member (not shown) so that the member 63 swings to raise and lower a downstream end 632 near the aligning portion, and thereby can be selectively located in the guide position P9 and the pushing position P10.

When the guide member 63 is located in the sheet guide position P9, it can smoothly guide the corner $S_1$ of the leading end, in the moving direction, of the sheet S into the aligning portion space 412*a*. When it is located in the sheet pushing position P10, the corner of the sheet leading end may be already located in the aligning portion space 412*a*. The guide member 63 in this state strongly presses and thereby straightens the corner portion of the sheet even when the corner portion is curled. Thereby, the space above the sheet(s) in the aligning portion space 412*a* can be increased as large as possible for easy reception of the next sheet. Owing to the pressing, the stapling by the stapler can be performed easily and accurately.

The guide member moving device 64 may be formed of a spring 641 which always biases the guide member 63 toward the sheet guide position P9 as shown in the figure, and a cam device 642 which acts on the guide member 63 to locate the guide member 63 in the sheet pushing position P10 against the spring 641, although not restricted to this structure. Instead of the cam device, a solenoid or the like may be employed.

Such a structure may be employed that, based on the instruction sent from the controller CONT, the guide member moving device 64 locates the guide member 63 in the sheet pushing position P10 every time the transporting and aligning device B aligns a predetermined number of sheets in the space 412*a*.

As shown in the alternate long and short dash line in FIG. 16, a mechanical, electrical or electro mechanical detector 65 may be provided for detecting a size (space distance) Sz in the sheet stacking direction (vertical direction in this example) of the empty space in the aligning portion space 412*a* above the uppermost sheet. In this structure, the detector 65 is connected to the controller CONT, and the guide member moving device 64 moves the guide member 63 to the pushing position P10 in accordance with the instruction sent from the controller CONT when the empty space size Sz detected by the detector 65 decreases to or below the predetermined value.

(7) The mail bin device F which is the sheet accommodating unit arranged under the sheet-laid tray A will now be described (see FIG. 2).

Under the sheet-laid tray A, the mail bin device F which is an example of the second sheet accommodating portion is arranged.

The mail bin device F is provided with five bins 101 for accommodating the sheets, which are discharged from the sheet processing device (i.e., copying machine 9 in this example), in the predetermined bin(s) corresponding to the intended destination(s) or the like. A sheet discharge switching claw 102, which is driven by solenoid SOL, is arranged near each of the bins 101 except for the lowermost bin 101. A sheet transporting path 103 is arranged commonly to the switching claws 102.

Each solenoid SOL is connected to the controller CONT. The solenoid SOL for setting the switching claw 102 to the sheet discharge position can be turned on in accordance with the instruction sent from the controller CONT so that the switching claw 102 corresponding to the bin 101 to which the sheet is to be discharged is set to the sheet discharge position. In any one of the upper four stages, when the solenoid SOL is off, the claw 102 is set to the sheet non-discharge position. When the sheet is to be discharged to the lowermost bin 102, all the solenoid SOL is turned off.

(8) The upper tray T arranged above the sheet-laid tray A will now be described (see FIGS. 1, 2 and others).

The sheet-laid tray A is primarily used for stapling the sheets by the stapler or sorting the sheets. However, the upper tray T is arranged above the tray A for the purpose of merely accommodating the sheets.

(9) Description will now be given on the transporting device G for leading the sheet discharged from the sheet processing device (copying machine 9 in this example) to the sheet-laid tray A, the mail bin device F or the tray T (see FIG. 2).

The transporting device G is arranged within the main casing CA of the sheet accommodating device SA, and is provided with a first transporting path 71, which receives the sheet discharged from the sheet processing device (copying machine 9 in this example), and leads the received sheet to the sheet-laid tray A, i.e., the first accommodating portion. The transporting device G is also provided with a roller pair 72 which is arranged in the inlet of the path 71 for receiving and taking in the sheet, and a roller pair 73 arranged in the outlet for discharging the sheet. Further, the device G includes a second transporting path 74 for leading the sheet from a midway point in the first transporting path 71 to the mail bin device F, and a third transporting path 75 for leading the sheet to the upper tray T via the discharge roller pair 78.

Intermediate transporting roller pairs are arranged at appropriate positions in the transporting paths, respectively. Sheet transporting direction switching claws 76 and 77 are provided for the second and third transporting paths 74 and 75, respectively. Each switching claw is usually biased by a spring (not shown) and thereby is located in a position for transporting the sheet through the first transporting path 71. FIG. 2 shows the claws in the above positions, respectively. When energized, the solenoid SOL1 drives the switching claw 76 to lead the sheet to the second transporting path 74.

The switching claw 77 is driven by a solenoid SOL2 to lead the sheet to the third transporting path 75.

The rollers 72, 73, 78 and others are driven by a motor M7 (see FIG. 11) which is controlled by the controller CONT.

A punch unit U for punching the sheets, if necessary, is arranged immediately downstream from the sheet receiving roller pair 73, and a waste receiver Ur is arranged under the punch unit U.

The solenoids SOL1 and SOL2 as well as the punch unit U are connected to the controller CONT, and are turned on in accordance with predetermined timing determined by the instruction sent from the controller CONT, when required.

The second transporting path 74 extends through the escape region of the processing tray 11. As shown in FIGS. 2 and 3, a member 741 provided with a sheet pass hole h is arranged in a portion of a region including the escape position of the processing tray 11. The member 741 is coupled to the rear end of the processing tray 11 via a spring 742.

When the processing tray 11 is located in the sheet receiving position P1, the member 741 is pulled by the spring 742 to a position where the hole h is located in the second transporting path 74, and is fixed there by a stop (not shown) which comes into contact with the member 741. When the processing tray 11 retreats to the escape position P2, the member 741 is pushed via the spring 742, and retreats the required minimum distance along the guide (not shown). For leading the sheet to the mail bin device F, it is merely required to arrange the processing tray 11 in the sheet receiving position P1.

The processing tray 11 may be provided with a hole, through which the sheet moving in the second transporting path 74 can pass when the processing tray 11 is in the escape position P2.

In any one of the structures, the second transporting path 74 extends through the escape region of the processing tray 11. Thereby, the sheet accommodating device SA can have a small and compact structure.

The whole operation of the sheet accommodating device SA described above will now be described.

First, description will be given on the operation of accommodating the sheets, which are discharged from the copying machine 9 via the sheet transporting device G, on the sheet-laid tray A. The fact that the sheet-laid tray A is to be used is instructed through the copying machine operation panel PAN connected to the controller C-CONT on the copying machine.

Initially, the processing tray 11 is located in the sheet receiving position P1, and stops there in accordance with information sent from the sensor S1 (see FIG. 3) detecting the tray 11. The carrying tray 12 is detected by a sensor S2 (see FIG. 3) arranged on the lower surface of the processing tray 11, and is initially located in the lower escape position which is spaced downward by a predetermined distance from the raised position.

In the transporting and aligning device B, the first transporting and aligning member 211 is located in the home position P3, and is detected there by a sensor S3 (see FIG. 4). As shown in FIG. 5, the arm 224 supporting the second transporting and aligning member (rotary paddle) 221 is in the raised position where it is in contact with the upper stop 227, and thereby the rotary paddle 221 stays in the same position.

In the transporting and sorting device C, the alignment reference member 31 is located in the home position, i.e., the alignment reference position $Q_0$, and is detected there by a sensor S4 (see FIG. 4).

In the sheet pushing device E, the pushing members 51 are located in the raised escape position P5, and the arm 53 supporting the pushing member 51 is stopped in the position where it is in contact with the stop 530 (see FIG. 4). Thereby, the guiding and pressing member 61 opposed to the aligning portion space 412*a* of the stapler D is biased in the sheet pushing direction by the spring 623 which is set in a state providing a large elastic force.

In the sheet transporting device G, the first transporting path 71 is ensured.

The sheets S which are discharged one by one from the copying machine 9 are guided by the first transporting path 71. When an appropriate instruction is already entered via the copying machine operation panel PAN, the sheets are punched by the punch unit U and are discharged onto the sheet-laid tray A one by one. A sheet passage sensor S7 (see FIG. 3) is arranged near the discharge roller pair 73 of the transporting path 71 for detecting the sheet discharging and the number of the discharged sheets.

Figure 12A:
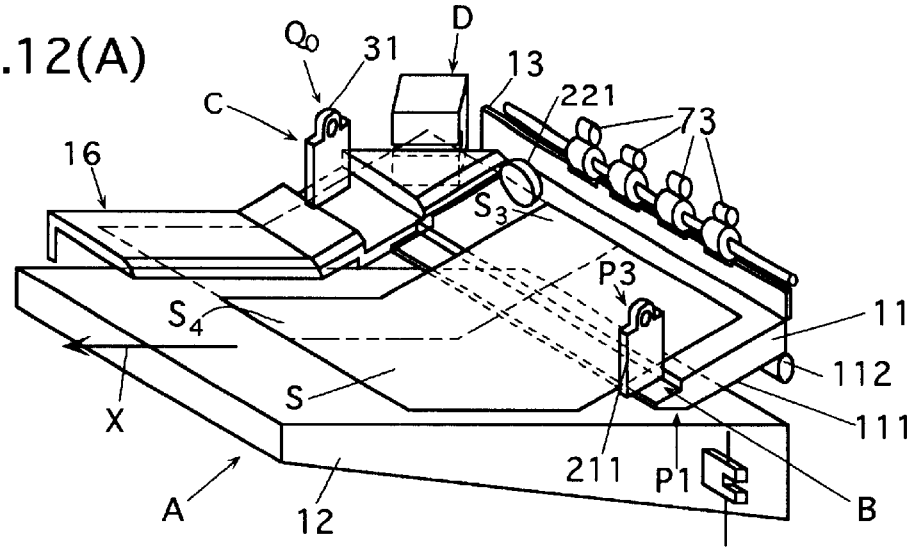
FIGS. 12(A), 12(B) and 12(C) show some of sheet processing steps performed by the sheet accommodating device shown in FIG. 1.

When the first one sheet S is discharged onto the tray A, the sheet is located in the state shown in FIG. 12(A). In this state, the rear end (upstream end) S3 in the sheet discharging direction of the sheet and a small portion continuing to the rear end $S_3$ are laid on the processing tray 11, and a remaining portion $S_4$ protruded beyond the processing tray 11 is laid on the carrying tray 12.

In this manner, the sheet S is laid in the initial position on the tray A. After a predetermined time, the pushing members 51 in the sheet pushing device E lower toward the sheet pushing position in accordance with the instruction sent from the controller CONT, and the rear end S3 of the sheet is pushed toward the processing tray 11. Thereby, even the curled sheet rear end is straightened, and attains the state allowing smooth and accurate aligning processing. As the pushing members 51 lower to the sheet pushing position, the guide member 61 which is biased by the spring 623 having the weakened elastic force is set to the state where it is weakly biased in the sheet pushing direction. Further, the rotary paddle 221 lowers to the sheet transporting position and starts the rotating and therefore sheet transporting operation.

While the pushing members 51 are pushing the rear end $S_3$ of the sheet S, the first transporting and aligning member 211 is moved in the aligning direction so that the member 211 pushes the sheet S toward the alignment reference member 31 and the aligning portion space 412*a* of the stapler D.

When the transporting member 211 reaches the sheet passing or transferring position P4 (e.g., position P4 shown in FIG. 4) depending on the sheet size in accordance with the instruction sent from the controller CONT, the member 211 returns to and stops at the home position P3 where it is detected by the sensor S3. As described above, the transporting member 211 of which moving speed cannot be increased to a large extent moves only a short distance, and returns to the home position. Therefore, the time before receiving the next sheet is reduced, and the sheet accommodating operation can be performed more efficiently.

The sheet S is then transported by the rotary paddle 211, and comes into contact with the alignment reference member 31. At the same time, the rear end corner S1 of the sheet is accurately and smoothly guided by the guide member 61 into the aligning portion space 412*a* of the stapler D, and is aligned thereby.

The pushing members 51 return to the raised escape position in accordance with the instruction of the controller CONT after the sheets are aligned (i.e., after elapsing of the time required for sheet alignment), and the pushing member drive motor M6 will stop after the right arm 53 comes into contact with the stop 530 (see FIG. 4).

As the pushing members 51 retreat to the upper escape position, the guide member 61 is strongly biased by the spring 623 having an increased elastic force, and thereby strongly pushes the sheet rear end $S_1$ located in the stapler aligning portion space 412*a*. Thereby, even the curled sheet portion is straightened, and the space above the sheet in the space 412*a* increases so that the next sheet can be easily and smoothly supplied thereto.

In this manner, the sheets discharged from the copying machine 9 are laid and aligned on the sheet-laid tray A one by one. During this, the paddle 221 stays in the sheet transporting position and continuously rotates.

Figure 12B:
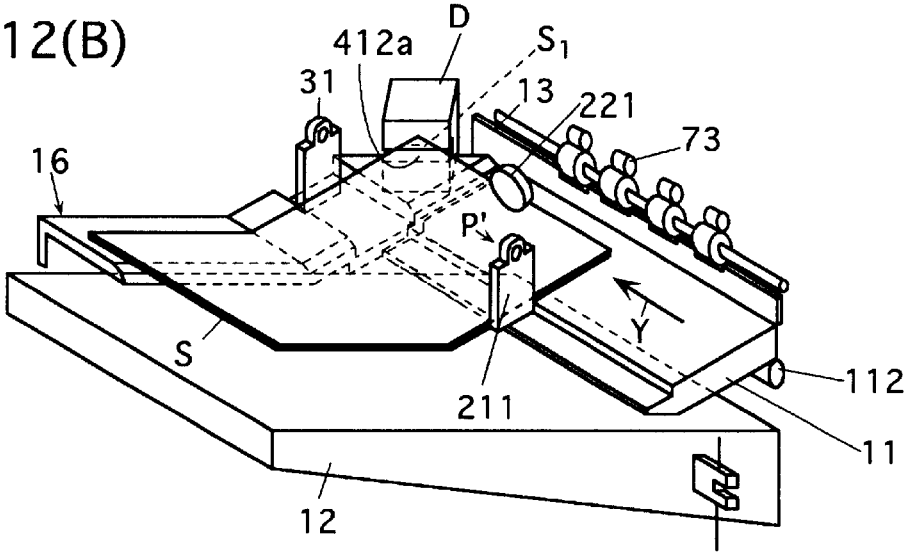

When aligning the last sheet among the predetermined number of sheets, the first transporting and aligning member 211 advances to and stops at a position P' (see FIG. 12(B)) for holding the last sheet between the member 211 and the alignment reference member 31 in accordance with the instruction which is sent from the controller CONT based on the size of the sheet. Then, the first transporting and aligning member 211 stays there for the later sorting.

When the alignment of the last sheet is completed, the rotary paddle 221 rises to the escape position, and the arm 224 supporting the paddle 221 comes into contact with the upper stop 227 (see FIG. 5). Then, the paddle drive motor M4 stops.

Figure 12C:
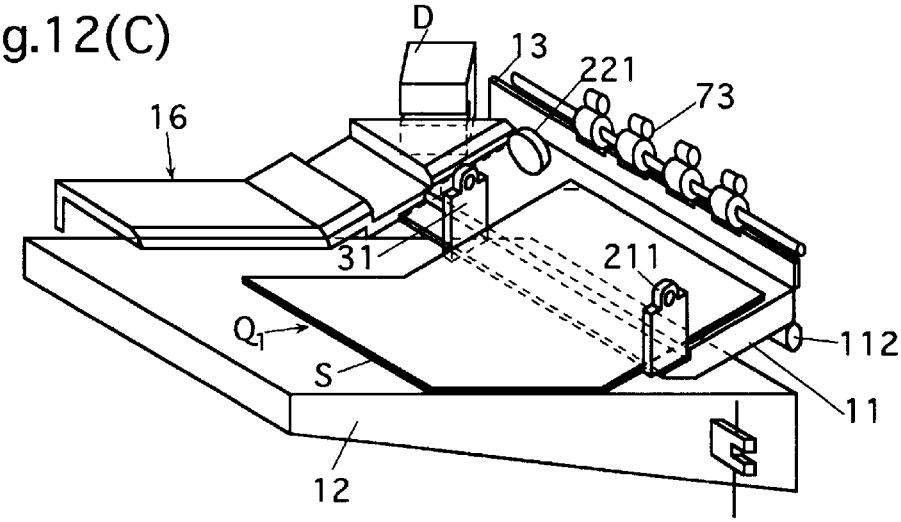

As shown in FIGS. 12(B) and 12(C), when the predetermined number of sheets are laid on the sheet-laid tray and are aligned, the stapler D staples the predetermined number of sheets if the stapling by the stapler D is already instructed via the operation panel PAN on the copying machine 9. If the stapling has not been instructed, the alignment reference member 31 in the transporting and sorting device C pushes back the sheets to the first position Q1 on the tray A in accordance with the instruction sent from the controller CONT after the alignment of the sheets is completed. In this operation, the first transporting and aligning member 211 which is located on the side opposite to the sheets retreats together with the sheets toward the home position P3. As described above, the sheets move together with the alignment reference member 31 and the transporting member 211, which hold the sheets therebetween, so that disadvantages such as disorder in position of the sheets and loosening of the sheet bundle can be avoided.

Figure 13A:
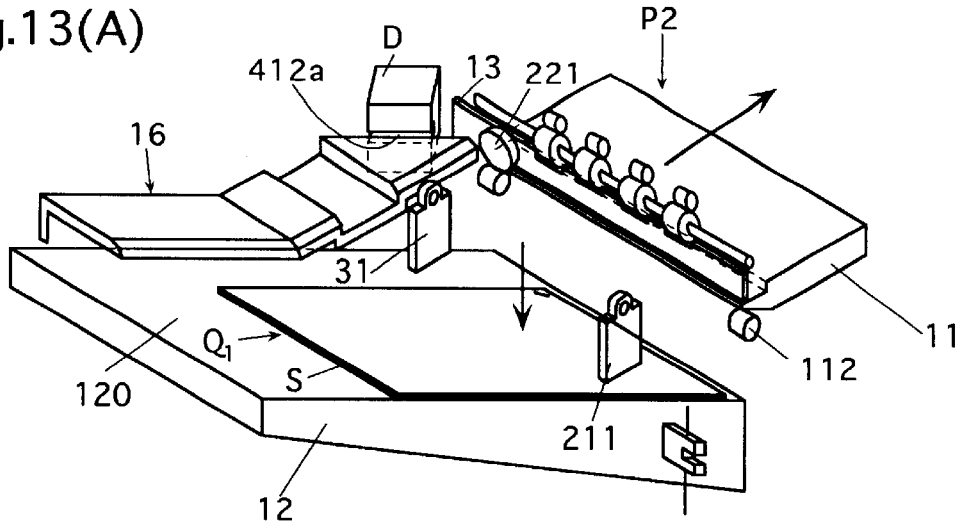
FIGS. 13(A), 13(B) and 13(C) show some other sheet processing steps performed by the sheet accommodating device shown in FIG. 1.

After the sheets move to the position Q1, the processing tray 11 retreats to the escape position P2 in accordance with the instruction sent from the controller CONT as shown in FIG. 13(A). Thereby, the sheet bundle falls onto an upper surface 120 of the carrying tray 12 under its own weight, and the alignment reference member 31 returns to and stops at the alignment reference position $Q_0$ where it is detected by the sensor S4.

Description will now be given on the operation of the carrying tray 12. The carrying tray 12 rises to the sheet carrying position in accordance with the instruction sent from the controller CONT while the processing tray 11 is still in the sheet receiving position P1 after start of the predetermined sheet processing operation (i.e., printing operation in the sheet processing device 9 in this example).

When the carrying tray 12 reaches the sheet carrying position, the switch activating member 116 arranged on the processing tray 11 is pushed to turn by the carrying tray 12 so that the switch SW1 is activated to stop the carrying tray drive motor M2. The carrying tray 12 may further rise to damage, e.g., the trays 11 and 12, or the sheets which are already laid on the tray 12 may be damaged. If such disadvantages or the like may occur, the switch activating member 116 further rotates to activate the switch SW2 so that the motor M2 stops, and rising of the carrying tray 12 is inhibited. The member 116 and the switch SW1 are an example of a detector for detecting the level of the upper surface of the sheet stack on the carrying tray 12.

After the vertical position of the carrying tray 12 is adjusted to the predetermined sheet carrying position, the processing tray 11 is retreated to the escape position P2 as shown in FIG. 13(A).

As the processing tray 11 retreats, the rear end portions $S_3$ of the sheets on the processing tray 11 fall onto the carrying tray 12 under their own weights. In this operation, the sheets move a short and constant distance so that disorder in position of the sheets, loosening thereof and others can be suppressed, and the sheets can be stably carried on the carrying tray 12.

For moving the sheets on the processing tray 11 onto the carrying tray 12, the pushing members 51 lower again to push the sheet rear end portions $S_3$ toward the carrying tray. Thereby, the sheets can move more smoothly onto the carrying tray 12. Thereafter, the pushing members 51 rise to the escape position for the next sheet alignment.

The carrying tray 12 is inclined as described before. The degree or extent of this inclination is determined such that the sheets laid on the carrying tray 12 do not slide in the sheet discharging direction toward the alignment reference portion 14 (see FIG. 3). This effectively prevents the sheet from being caught by the alignment reference portion 14, and allows smooth fall of the sheet from the processing tray 11 to the carrying tray 12.

After the processing tray 11 retreats to the escape position P2, the carrying tray 12 lowers a predetermined constant distance to the escape position in accordance with the instruction sent from the controller CONT.

After the carrying tray 12 lowers to the escape position, the processing tray 11 advances to the sheet receiving position P1 again. At the time slightly preceding the start of movement of the processing tray 11 in the above operation, a belt 153 forming a portion of the alignment reference portion 14 is turned to drive downward the rear end of the sheet on the carrying tray 12. Thereby, even if the rear end of the sheet on the carrying tray 12 is curled upward, the rear end is pulled downward so that the processing tray 12 can move to the receiving position P1 without collision against the sheet. The belt 153 stops at the same time as the processing tray 11 stops in the receiving position P1.

The sheet rear end alignment reference portion 13 for the processing tray 11 and the sheet rear end alignment reference portion 14 for the carrying tray 12 are located on the same vertical plane. Instead of this arrangement, the sheet rear end alignment reference portion 14 may be shifted upstream, in the sheet discharging direction, from the alignment reference portion 13 in the upper position for preventing catch of the sheet rear end. In this case, the turnable belt 153 may be eliminated.

Figure 13B:
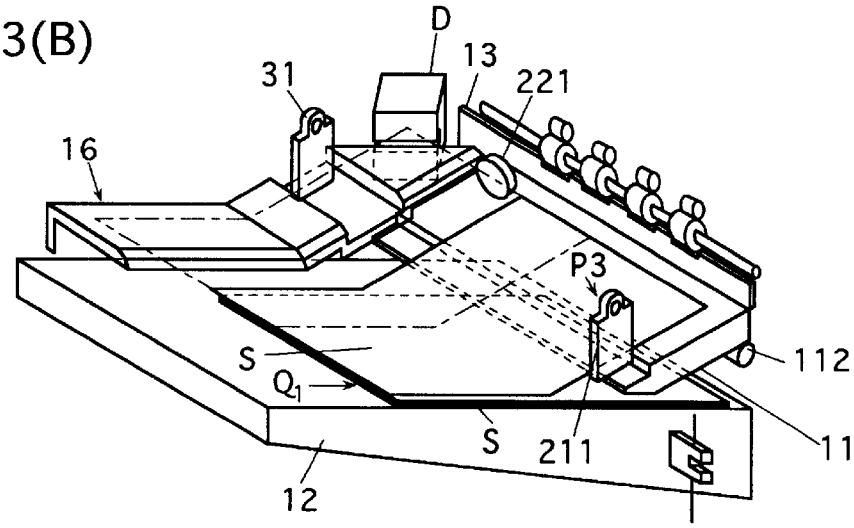
Figure 13C:
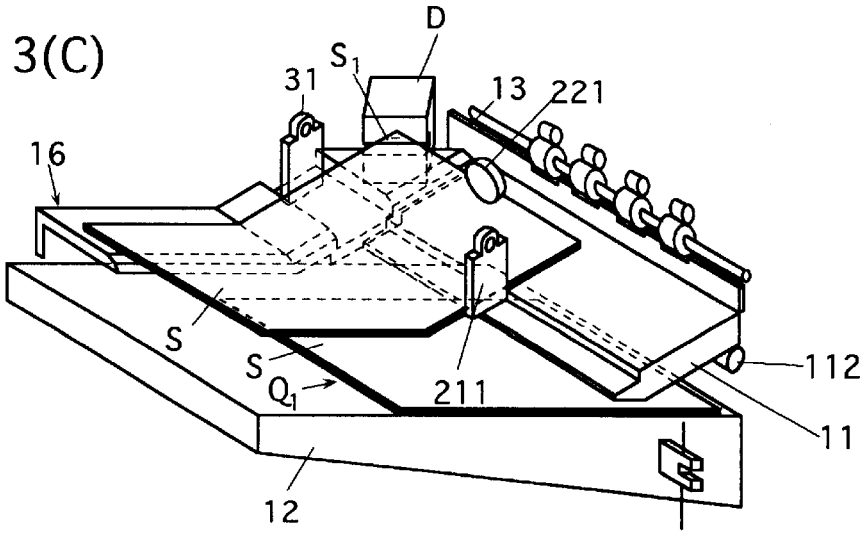
Figure 14A:
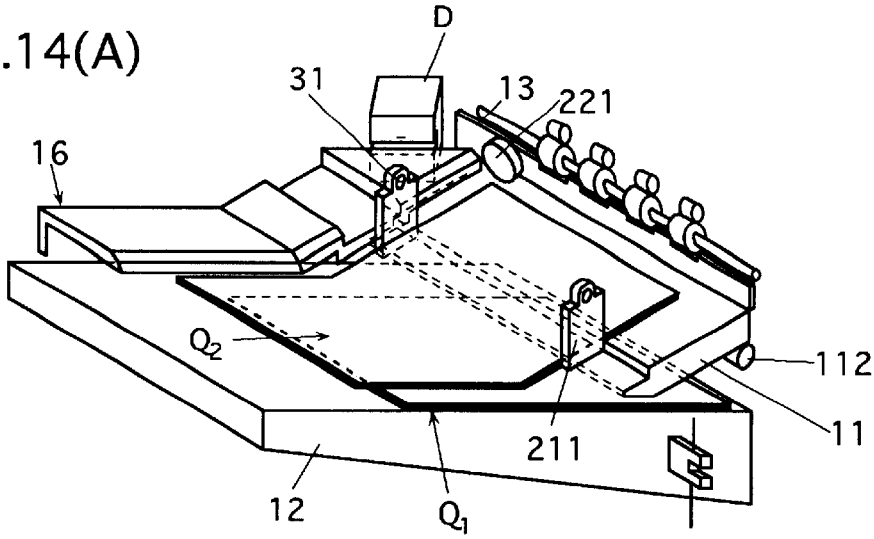
FIGS. 14(A), 14(B) and 14(C) show some further other sheet processing steps performed by the sheet accommodating device shown in FIG. 1.

As described above, the first stack of the predetermined number of sheets is laid and accommodated on the carrying tray 12, and the processing tray 11 is returned to the sheet receiving position P1. After this state is attained, the predetermined number of next sheets are received in the sheet-laid tray A one by one, and are aligned by the transporting and aligning device B, during which each sheet rear end is pushed by the pushing members 51 of the sheet pushing device E and the sheets are guided by the guide member 61, as shown in FIGS. 13(B) and 13(C). When the predetermined number of sheets are aligned, the stapling is executed if it is already instructed. Then, as shown in FIG. 14(A), the sheets are moved to the second position Q2 on the tray A while the sheets being held between the alignment reference member 31 of the transporting and sorting device C and the first transporting and aligning member 211.

Figure 14B:
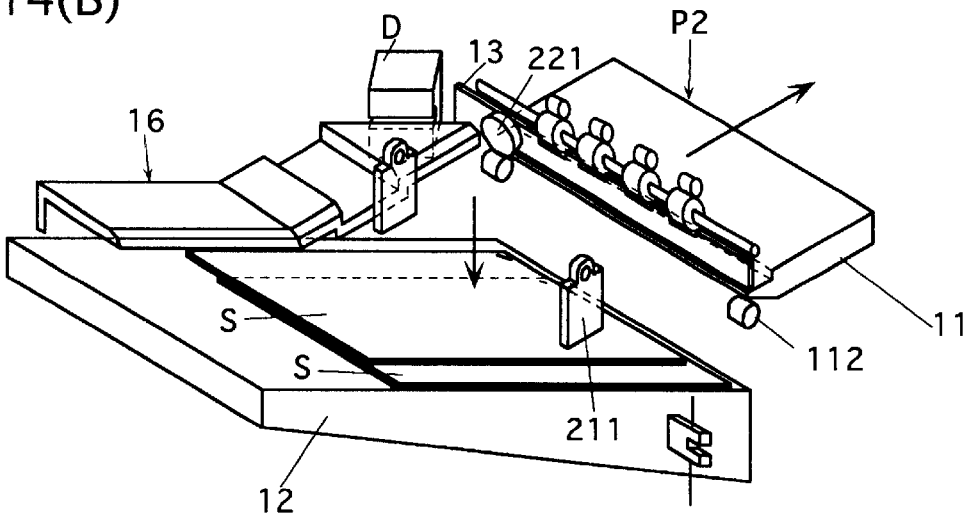

Thereafter, as shown in FIG. 14(B), the processing tray 11 is retreated to the escape position P2 for moving the sheets onto the carrying tray 12 by their own weights. Prior to this, the carrying tray 12 is raised to the sheet carrying position in accordance with the same timing as the foregoing operation.

Figure 17:
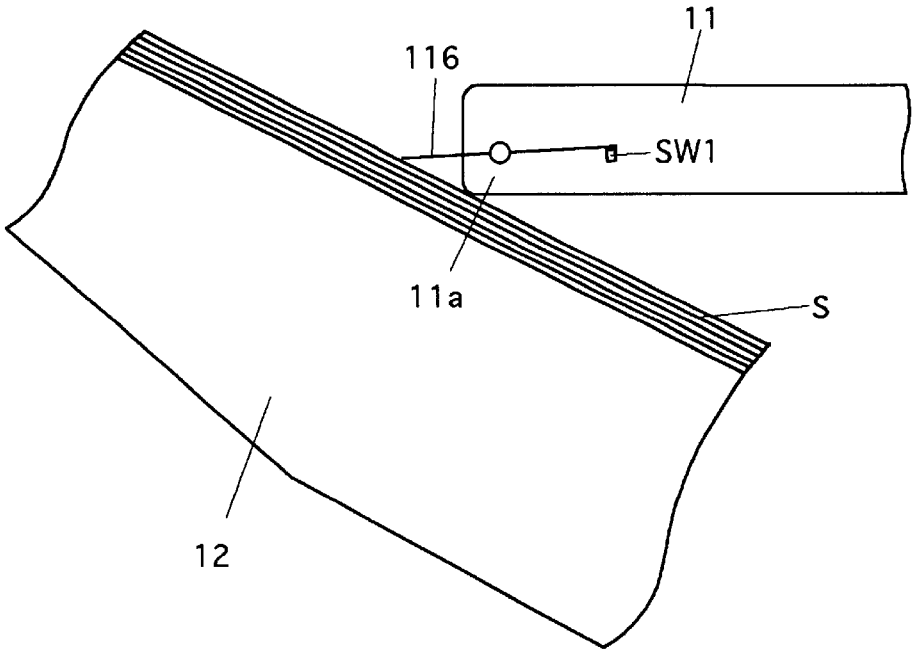
FIG. 17 shows a state in which a processing tray pushes a preceding sheet on a carrying tray.

When the carrying tray 12 is raised to the sheet carrying position, the leading end (downstream end in the sheet discharging direction) 11*a* of the processing tray 11 comes into contact with and thereby pushes the upper surface of the sheet S which is already laid on the carrying tray 12 as schematically shown in FIG. 17, in contrast to the manner of accommodating the first stack of the predetermined number of sheets. This pushing is performed to such an extent that the switch activating member 116 on the processing tray 11 is turned by a reaction force applied from the underlying sheet, and thereby activates the switch SW1. Upon activation of the switch SW1, the carrying tray 12 stops rising so that the tray 12 can reliably stay at the predetermined sheet carrying position, and the sheets on the tray 12 can be pushed to straighten the curled portion, if any. Thereby, the processing on the processing tray 11 can be performed easily and accurately.

Figure 14C:
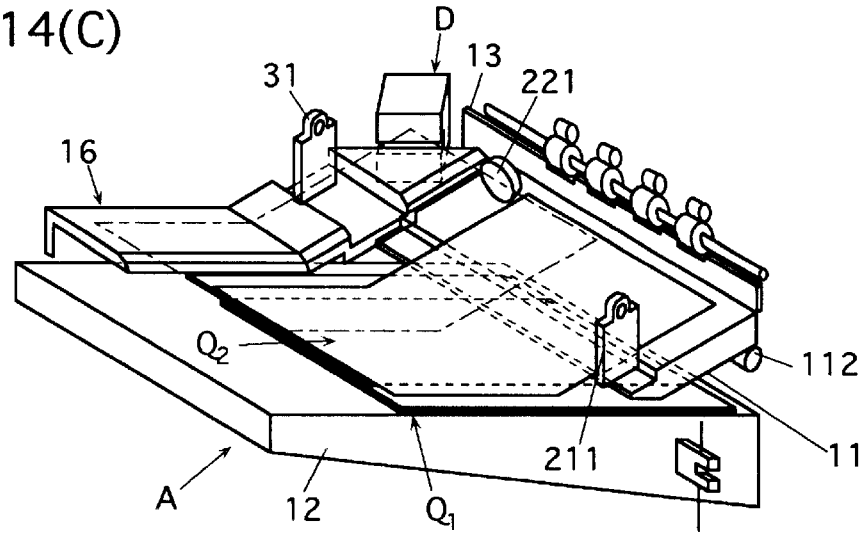

After the second stack of the predetermined number of sheets is laid on the carrying tray 12 as shown in FIG. 14(B), the carrying tray 12 is moved to the lower escape position, and the processing tray 11 is returned to the sheet receiving position for the next operation, as shown in FIG. 14(C).

The distance which the tray 12 lowers in this operation is equal to the distance which the tray 12 lowered after the first stack of the predetermined number of sheets was laid thereon. Accordingly, the escape position of the tray 12 for the second stack is lower than the first escape position of the tray 12 because the first stack was already laid on the tray 12 and was raised to the position where the first stack of the sheets was in contact with the processing tray 12. When the carrying tray 12 is to be lowered to the escape position, the controller CONT lowers it by the predetermined constant distance.

By repeating the above operations the necessary times, the predetermined volume of sorted sheets can be neatly laid and accommodated on the carrying tray 12 in the ordered fashion.

In this example, the switch activating member 116 and the switch SW1 are employed as the device for detecting the vertical position of the upper surface of the portion of the sheet(s) on the carrying tray 12 pushed by the processing tray 11 or the neighboring portion. Instead of this, a sensor (e.g., a distance detecting sensor) for detecting the sheet surface height of the sheet(s) on the carrying tray 12 may be arranged, e.g., above the tray A, and may be connected to the controller CONT. In this structure, the operation of the carrying tray drive motor M2 is controlled to adjust (control) the vertical position of the tray 12 based on the result of detection of the above sensor.

When the carrying tray 12 on which the sheets are already laid is raised to the sheet carrying position, the position of the sheets which are already laid on the tray 12 is the same as the position where the sheets were returned from the aligning position $Q_0$ by the transporting and sorting device C. Therefore, a state where the upper surface of the carrying tray 12 is shifted downward from the alignment reference position may occur on the side of the alignment reference position of the sheets already laid on the carrying tray 12. In view of this, the structure may employ a side tray for supporting the sheets aligned in the alignment reference position $Q_0$, and particularly the sheet ends near the alignment reference position $Q_0$. This tray is shown as a side tray 16, which is shown only in FIGS. 12 to 14.

In accordance with the instruction entered via the operation panel PAN on the copying machine 9, the mail bin device G and the upper tray T can be selectively used by switching the positions of the sheet transporting direction switching claws 76 and 77 in the transporting device G.

Figure 18:
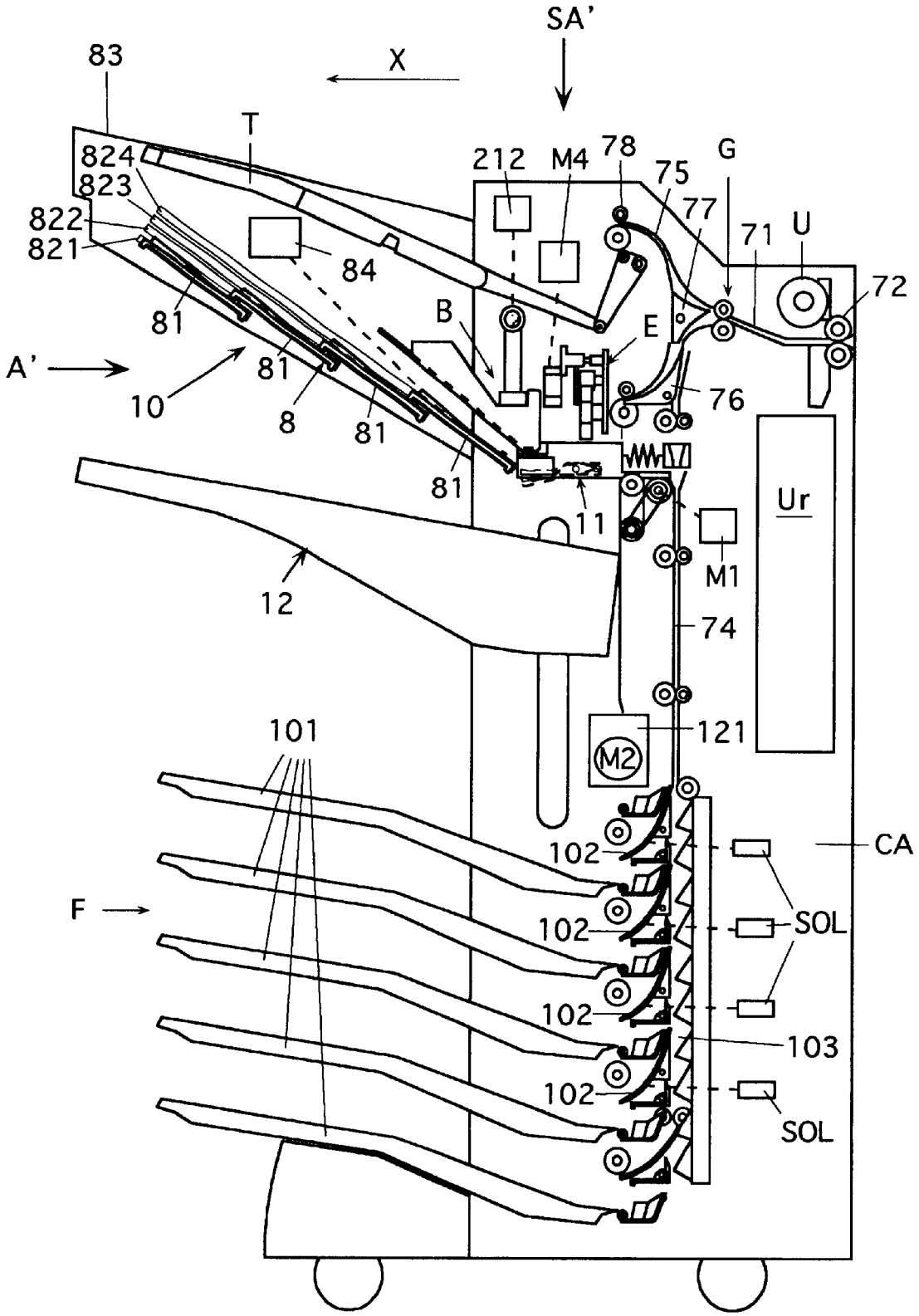
FIG. 18 is a schematic side view of an internal structure of another example of the sheet accommodating device according to the invention.

Description will now be given on a sheet accommodating device SA' according to another embodiment of the invention. FIG. 18 is a side view schematically showing an internal structure of the sheet accommodating device SA'.

The structure and operation of the sheet accommodating device SA' are the same as those of the sheet accommodating device SA except for a sheet-laid tray A'. The sheet accommodating device SA' is provided with the transporting and aligning device B, the transporting and sorting device C, the stapler D, the sheet pushing device E, the pressing member 61 also serving as the guide member for guiding the sheet to the stapler D, the biasing device 62 for the member 61, the mail bin device F, the upper tray T, the transporting device G and others, which are the same as those of the sheet accommodating device SA already described with reference to FIG. 1 and others. These devices and members operate in the same manner as those in the device SA. The same parts, members and others as those in the device SA bear the same reference numbers or characters.

Description will now be given primarily on the sheet-laid tray A'.

As shown in FIG. 18, the sheet-laid tray A' can move between the sheet receiving position and the retreated escape position. In the sheet receiving position, the sheet-laid tray A' receives the sheet discharged from the sheet processing device (copying machine 9 in this example), and supports the whole lower surface of the sheet. The tray A' includes a processing tray 10 used for aligning the sheets in the sheet receiving position, and the sheet carrying tray 12.

The processing tray 10 is formed of a first small tray 8 and a second small tray 11, which can be escaped in different directions, respectively. Hereinafter, the first small tray 8 may be merely referred to as the "first tray 8" or "tray 8", and the second small tray 11 will be merely referred to as the "second tray 11" or "tray 11".

The second tray 11 has the same structure as well as the same operation and function as the processing tray 11 in the sheet accommodating device SA. The first tray 8 is formed of a plurality of divided trays 81, which are layered when they are in the escape position.

The carrying tray 12 has the same structure as well as the operation and function as those of the carrying tray 12 in the sheet accommodating device SA.

More specifically, the first tray 8 can be considered as an auxiliary tray. The divided trays 81 forming the tray 8 can move between the sheet receiving positions and the escape positions along the four guide rails or rail sets 821, 822, 823 and 824, each of which is inclined upward and downstream in the sheet discharging direction X.

Figure 19:
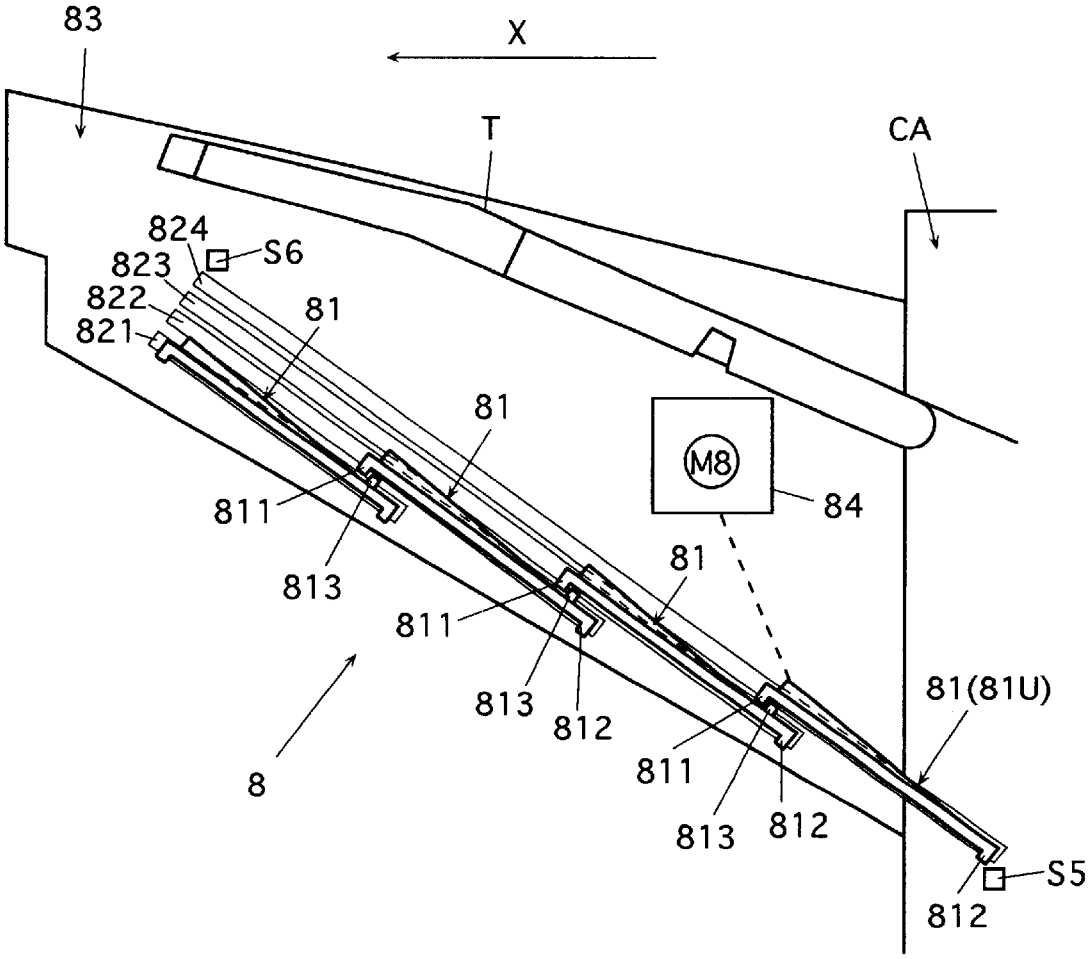
FIG. 19 shows, on an enlarged scale, a processing tray in the sheet accommodating device shown in FIG. 18.

These guide rails are formed on the inner surfaces of a tray support frame 83 projected from the main casing CA of the device SA', and more specifically on the left and right inner surfaces in the front view. FIGS. 18 and 19 show the guide rails only on the left side in the front view.

Each guide rail is longer than the rail in the lower position so that the lowermost rail 821 is the shortest, and the uppermost rail 824 is the longest. These rails have the downstream ends in the sheet discharging direction X (i.e., the upper ends) which are aligned with each other. Each guide rail (e.g., 824) is longer than the neighboring lower rail (e.g., 823) by a length slightly shorter than the length of each divided tray 81 in the sheet discharging direction X.

Each of the divided trays 81 which can rise and lower along the guide rails 822, 823 and 824 has engagement portions 811 and 812 on the lower surfaces of the opposite ends thereof in the sheet discharging direction, respectively. Each of the divided trays 81 which can rise and lower along the guide rails 821, 822 and 823 has an engagement projection 813 on the upper surface of the upstream end thereof in the sheet discharging direction.

When each divided tray 81 is in the sheet receiving position shown in FIGS. 18 and 19, the neighboring two divided trays 81 are arranged in a state which can prevent the sheet from being caught while it is being discharged, and more specifically are arranged in such a state that the downstream end of the upstream (i.e., upper) divided tray 81 overlaps with the upstream end of the downstream (i.e., lower) divided tray 81. In this state, the downstream engagement portion 811 of the upper divided tray 81 is engaged with the upper surface engagement projection 813 of the lower divided tray 81.

A drive device 84 is provided for these divided trays 81. The drive device 84 includes a reversible motor M8 and a transmission device for transmitting the power of the motor M8 to the uppermost tray 81U.

When the divided tray 81 moves from the sheet receiving position to the escape position, one of the neighboring trays 81 is moved by the force applied from the other.

More specifically, when the motor M8 operates to raise the most upstream (uppermost) tray 81 (81U) from the sheet receiving position along the guide rail 824, the upstream engagement portion 812 of the tray 81U engages with the upper surface engagement projection 813 of the lower tray 81, and the lower tray 81 is driven by the upper tray 81 to rise to the escape position along the guide rail 823.

In the above manner, the lower tray 81 between the neighboring trays is moved by the upper tray 81 toward the escape position. When all the trays 81 retreat to the escape positions, these trays 81 are accommodated in a layered fashion as shown in FIG. 20(E). This structure for the escape position can avoid increase in size of the whole structure, and can provide the compact structure.

The trays 81 accommodated in the layered fashion can be expanded to the sheet receiving position by reversing the motor M8. More specifically, the uppermost tray 81U is driven to lower, whereby the lower trays 81 successively lower under their own weights. In this operation, the lower tray may not sufficiently lower due to its insufficient weight. Even in this case, the lower tray can be lowered by the upper tray because the engagement portion 811 at the downstream end of the upper tray 81 engages with the upper surface engagement projection 813 of the lower tray 81. In this manner, the tray 8 (divided trays 81) can be located in the sheet receiving position.

In the structure employing the above tray 8, the motor M8 is configured to operate in accordance with the instruction sent from the controller CONT shown in FIG. 11, and such a structure is also employed that the second tray 8 (divided trays 81) can be located in the sheet receiving position shown in FIGS. 18 and 19 or in the escape position where the divided trays 81 are layered as shown in FIG. 20(E) and others.

When the divided trays 81 moved from the escape positions reach the sheet receiving positions, the sensor S5 (see FIG. 19) detects the uppermost tray 81U so that the whole tray 8 stops. When the divided trays moved from the sheet receiving positions reach the uppermost escape positions, the sensor S6 (see FIG. 19) detects the uppermost tray 81U, and the whole tray stops.

According to the sheet-laid tray A', when the processing tray 10 is located in the sheet receiving position, and therefore the processing tray 11 and the tray 8 (divided trays 81) are located in the sheet receiving positions shown in FIGS. 18 and 19, the space between the processing tray 11 and the carrying tray 12 diverges in the sheet discharging direction X (i.e., downstream in the sheet discharging direction X).

The operation of the sheet accommodating device SA' described above is the same as the operation of the sheet accommodating device SA already described except for that the operation of the additional tray 8. Therefore, the following description will be given primarily on the operation of the processing tray 10, and the other operation will not be described.

Figure 20A:
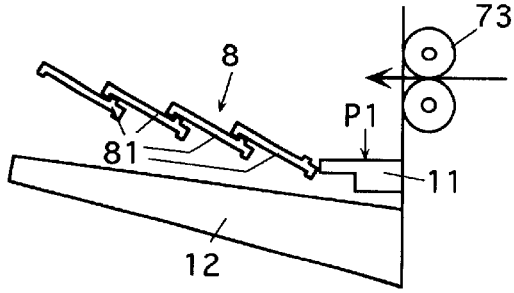
FIGS. 20(A)–20(H) show sheet processing steps performed by the processing tray in FIG. 18.

The processing tray 10 is initially located in the sheet receiving position shown in FIGS. 18, 19 and 20(A). In this state, the uppermost (the most upstream) tray 81U is detected by the sensor S5, and thereby the tray 8 stays in the initial position.

Figure 20B:
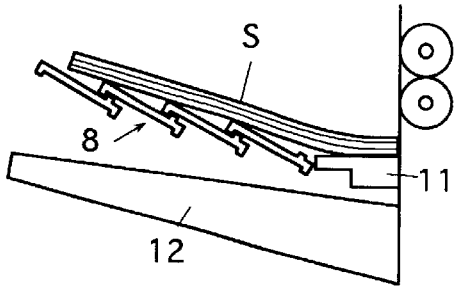

Then, as shown in FIG. 20(B), the sheets S discharged from the sheet processing device 9 are laid on the processing tray 10 one by one. More specifically, the rear end portion of the sheet is laid on the processing tray 11, and the other portion is laid on the tray 8. These sheets are aligned one by one similarly to the operation of the device SA.

When the predetermined number of sheets are aligned, the sorting without stapling or the sorting after the stapling by the stapler D is performed similarly to the operation by the device SA.

The sheet processing on the processing tray 10 is performed in such a state that the processing tray 10 supports the whole lower surface of the sheet to be processed. Owing to this, aligning and other processing can be effected more smoothly and accurately on the sheets on the processing tray 10 even if the preceding sheets are present on the carrying tray 12.

The carrying tray 12 is arranged to increase a space with respect to the processing tray 10 arranged in the sheet receiving position as the position moves in the direction X of the sheet discharging from the sheet processing device. Therefore, even if the sheet carried and accommodated on the carrying tray 12 is curled and therefore extends upward toward the processing tray 10, a contact between the sheet and the processing tray 10 can be avoided, or can occur only to an ignorable extent. Therefore, the sheets on the carrying tray 12 are not disturbed, and the operation of the processing tray 10 is not impeded.

Figure 20C:
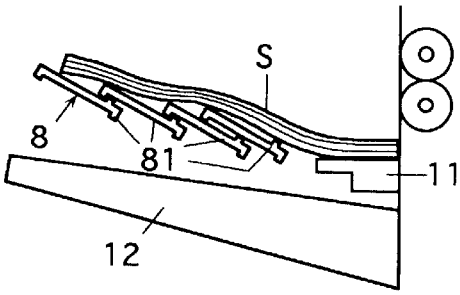

After the predetermined number of sheets are discharged onto the processing tray 10, one or some of the divided trays 81 forming the tray 8 are preliminarily escaped in accordance with the instruction, which is sent from the controller CONT and depends on the sheet size, to an extent not impeding the subsequent processing such as sorting, as shown in FIG. 20(C).

By preliminarily escaping the tray(s) 81, it is possible to reduce the time period required between the time when it becomes possible to move the sheets from the processing tray 10 onto the carrying tray 12 and the subsequent time when escaping of the processing tray is completed. This allows more efficient accommodation of the sheets.

Figure 20D:
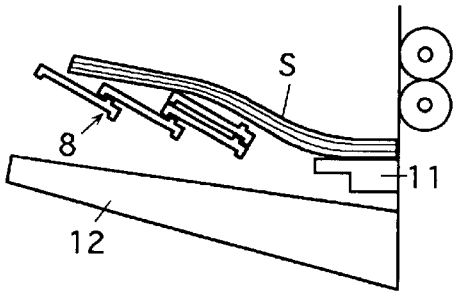
Figure 20E:
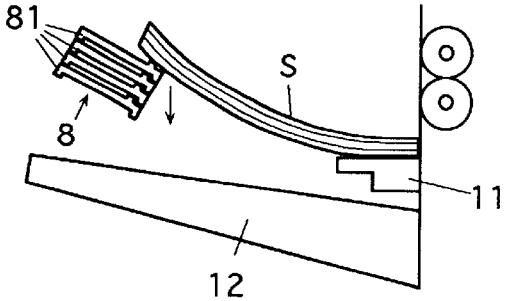

The sheets S which are subjected to the predetermined processing on the processing tray 10 then fall from the tray 8 onto the carrying tray 12 under their own weights as a result of the operation in which the tray 8 in the preliminary escape position moves to the escape position based on the instruction of the controller CONT as shown in FIGS. 20(D) and 20(E).

Figure 20F:
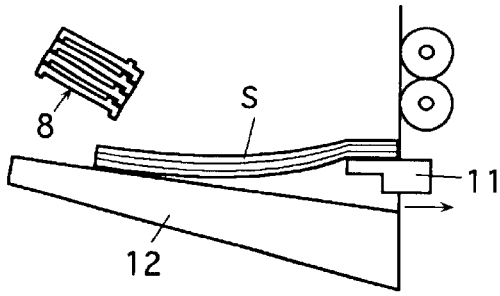
Figure 20G:
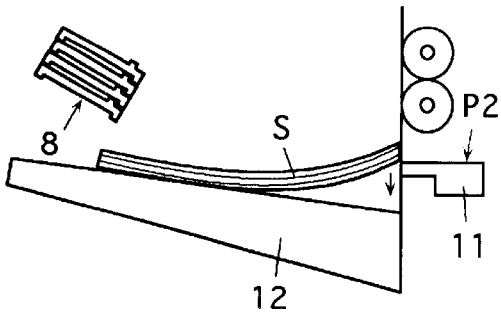
Figure 20H:
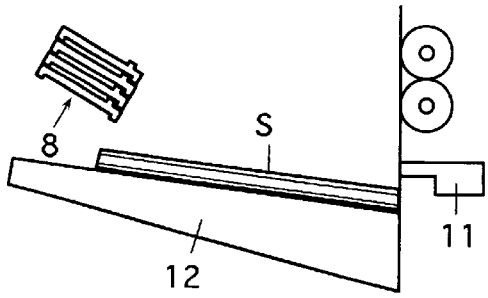

In this operation, the tray 8 moves an escape distance. This escape distance is determined such that the tray 8 is not completely escaped from the lower surface portion of the sheet supported on the tray 8, and in other words, is not escaped from a portion of the sheet lower surface depending on the sheet size, as shown in FIG. 20(E). Even if the tray 8 escapes to the position shown in FIG. 20(E), the sheet curves and falls onto the tray 12 under its own weight as shown in FIG. 20(F). However, the sheet rear end is still present on the processing tray 11. Therefore, as shown in FIGS. 20(F) through 20(H), the processing tray 11 retreats to the escape position P2 in accordance with the instruction sent from the controller CONT. Thereby, the sheet rear end is also laid on the carrying tray 12.

Thereafter, the tray 8 and the processing tray 11 are located in the initial sheet receiving positions again for the next processing such as aligning of the predetermined number of sheets.

For moving the sheet portion on the tray 8 onto the tray 12, the tray 8 is not completely escaped as shown in FIG. 20(E). The purpose of this is to reduce the escape time period as well as the time period required for next return of the tray 8 to the sheet receiving position, and thus is to perform efficiently the operation of accommodating the sheets.

The processing tray 11 is escaped after the tray 8 is escaped for the following reason. If the processing tray 11 were retreated to the escape position prior to the tray 8, the sheet rear end would be likely to be caught by the member (e.g., alignment reference portion 13 or 14) opposed thereto when the sheet rear end move to the carrying tray.

In any one of the foregoing structures, the processing tray 11 and the tray 8 escape in the different directions, respectively. This also allows reduction in the escape time, and thereby allows more efficient accommodation of the sheets.

According to the tray 8 described above, the plurality of divided trays 81 move along the different guide rails. However, such a structure may be employed that the plurality of divided trays move along the common guide rails.

FIG. 21 shows an example of the above structure using the common rails. A tray 8' shown in FIG. 21 includes a plurality of divided trays 81'. Each tray 81' can move along a pair of parallel guide rails 82' common to all the trays 81'. FIG. 21 shows only one of the rails.

The guide rail 82' includes a portion 821' and a divided guide portion 822' parallel to the portion 821' which are bent to form a portion 80' accommodating the divided trays 81' in a stacked state.

A biasing device 83' for upward biasing which is formed of a spring in this example is arranged in a lower portion of the accommodating portion 80'.

Each divided tray 81' is provided at its each side portion with long and short pins 81*a* and 81*b* which project laterally. As shown in FIG. 21(C), these pins 81*a* and 81*b* are fitted into the guide rail 82' for movement along the rail 82'. In the accommodating portion 80', the long pin 81*a* moves in the bent portion 821', and the short pin 81*b* moves in the divided guide porion 822'.

Figure 21A:
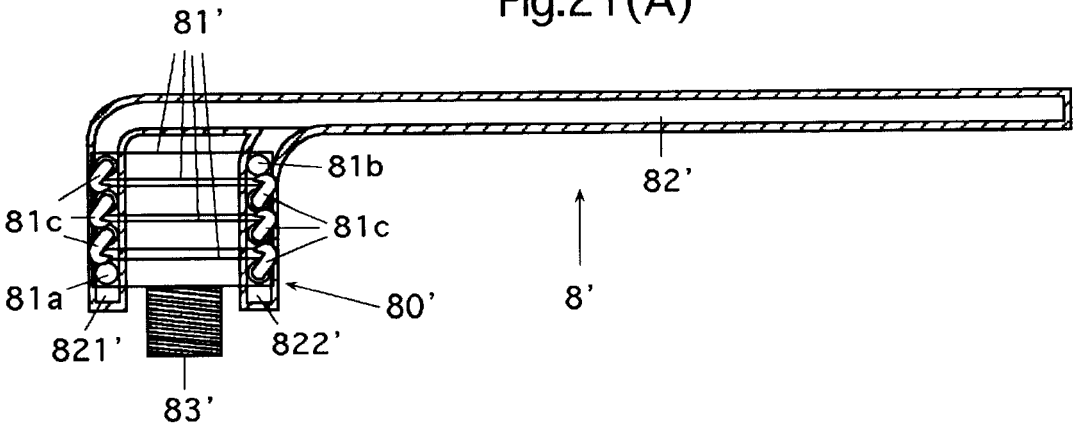
FIGS. 21(A)–21(C) show another example of small trays.
Figure 21B:
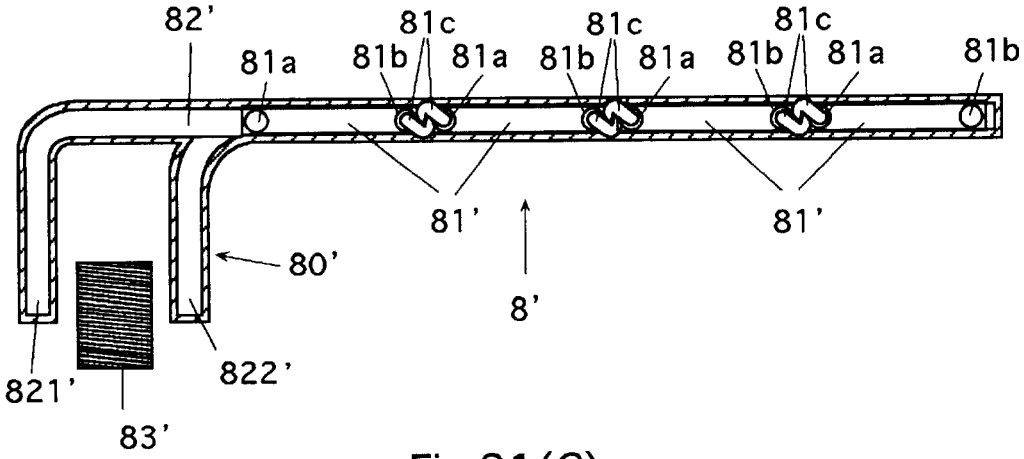
Figure 21C:
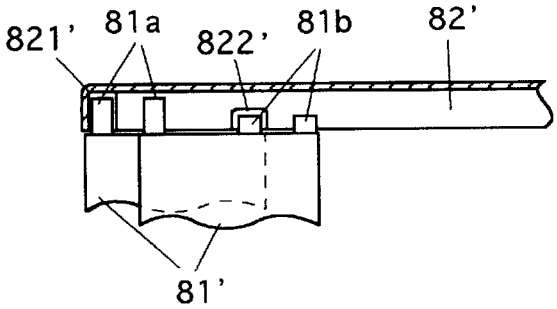

The pins 81*a* and 81*b* are provided with engagement portions 81*c* for the operation, in which the uppermost divided tray 81' moves from the stacked (i.e., accommodated) state in the escape position shown in FIG. 21(A) to the sheet receiving position shown in FIG. 21(B). More specifically, the engagement portions 81*c* are employed so that the preceding tray 81' may catch and drive the immediately following tray 81' in the above operation. In FIG. 21(*c*)., the engagement portion 81*c* is not shown.

According to the tray 8' described above, the divided trays 81' in the escape positions and thus in the accommodated positions shown in FIG. 21(A) can be pulled out along the guide rails 82' by driving the uppermost tray 81' and utilizing the upward pushing force of the biasing device 83'. Thereby, the other trays 81' are successively pulled up by the uppermost tray 81' and are pushed up by the biasing device 83'. In this manner, all the trays 81' can reach the sheet receiving positions on the common plane shown in FIG. 21(B). By reversely driving the trays 81' in the sheet receiving positions, the trays 81' can be stacked and accommodated in the escape positions against the force by the biasing device 83'.

Figure 22:
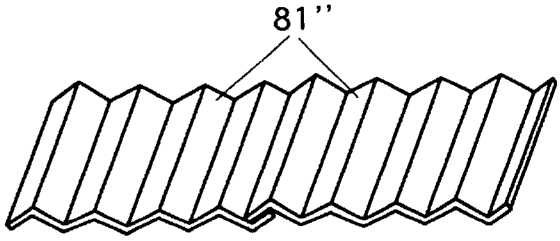
FIG. 22 is a perspective view showing still another example of the divided trays.

Instead of the above structure, divided trays exemplified in FIG. 22 may be employed. Each tray in FIG. 22 is made of a wavy plate 81" having ends, which can be engaged with ends of the neighboring plates 81", respectively.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A sheet accommodating device comprising:

a processing tray reciprocally movable between a receiving position for receiving a sheet and an escape position, the sheet being aligned in said receiving position; and a carrying tray for carrying a sheet or sheet bundle moved by its own weight as a result of retreating of said processing tray to the escape position, said processing tray being formed of a first tray supporting a sheet leading portion in the sheet discharging direction, and a second tray supporting a sheet rear portion.

2. The sheet accommodating device according to claim 1, wherein said first tray is formed of a plurality of a divided trays, and the divided trays are accommodated in a layered fashion.

3. The sheet accommodating device according to claim 1, wherein said first and second trays move substantially parallel to the sheet surface.

4. The sheet accommodating device according to claim 1, wherein said first and second trays are configured to retreat in the different directions along the sheet discharging direction.

5. A sheet accommodating device comprising:

a processing tray movable between a receiving position for receiving a sheet and an escape position, the sheet being aligned in said receiving position; and a carrying tray for carrying a sheet or sheet bundle moved by its own weight as a result of retreating of said processing tray to the escape position, said processing tray being formed of a first tray supporting a sheet leading portion in the sheet discharging direction, and a second tray supporting a sheet rear portion, wherein said first and second trays are configured such that said second tray escapes after said first tray escaped.

6. A sheet accommodating device comprising:

a processing tray movable between a receiving position for receiving a sheet and an escape position, the sheet being aligned in said receiving position; and a carrying tray for carrying a sheet or sheet bundle moved by its own weight as a result of retreating of said processing tray to the escape position, said processing tray being formed of a first tray supporting a sheet leading portion in the sheet discharging direction, and a second tray supporting a sheet rear portion, wherein said escape position of said first tray is a position still opposed to a portion of the lower surface of the sheet.

7. A sheet processing system formed of an image forming apparatus and a sheet accommodating device for accommodating sheets discharged from said image forming apparatus, wherein said image forming apparatus includes:

an image forming unit for forming an image on the sheet, and a discharging portion for discharging the sheet bearing the image; and said sheet accommodating device includes:

a processing tray movable between a receiving position for receiving a sheet and an escape position, the sheet being aligned in said receiving position; and a carrying tray for carrying a sheet or sheet bundle moved by its own weight as a result of retreating of said processing tray to the escape position, said processing tray being formed of a first tray supporting a sheet leading portion in the sheet discharging direction, and a second tray supporting a sheet rear portion.

* * * * *